United States Patent [19]

White

[11] Patent Number: 4,837,565

[45] Date of Patent: Jun. 6, 1989

[54] TRI-STATE FUNCTION INDICATOR

[75] Inventor: Randall A. White, Plainville, Mass.

[73] Assignee: Digital Equipment Corporation, Maynard, Mass.

[21] Appl. No.: 84,845

[22] Filed: Aug. 13, 1987

[51] Int. Cl.[4] ..... G05G 3/14

[52] U.S. Cl. ..... 340/762; 340/782; 340/815.03; 362/800

[58] Field of Search ..... 340/704, 762, 782, 815.03, 340/715, 701; 315/167; 313/500, 501, 510; 362/800

[56] References Cited

U.S. PATENT DOCUMENTS

| | | | |
|---|---|---|---|
| 3,840,858 | 10/1974 | Usui | 340/762 |
| 3,840,873 | 10/1974 | Usui | 340/762 |
| 4,420,711 | 12/1983 | Takahashi et al. | 340/704 |
| 4,488,149 | 12/1984 | Givens, Jr. | 340/762 |
| 4,491,974 | 1/1985 | Bouchant | 340/704 |
| 4,734,619 | 3/1988 | Haval | 340/762 |

FOREIGN PATENT DOCUMENTS

| | | | |
|---|---|---|---|
| 3009416 | 9/1981 | Fed. Rep. of Germany | 340/762 |
| 1285524 | 1/1987 | U.S.S.R. | 340/762 |

OTHER PUBLICATIONS

Kraus; "Two LEDs blend and blink to indicate six states"; Ideas for Design; Electronic Design; Aug./5/82; p. 72; vol. 30, No. 16.

Ralphsnyder; "2-color LED X 3 bits = 8 visual effects"; Design Ideas; vol. 26, No. 14; Jul./22/81; pp. 382–383.

*Primary Examiner*—John W. Caldwell, Sr.

*Assistant Examiner*—Mahmoud Fatahi-Yar

*Attorney, Agent, or Firm*—Kenyon & Kenyon

[57] ABSTRACT

In order to indicate a function status which can be one of three states, upon detecting a first state, a bicolor LED is lighted with a first color; upon detecting a second state, the LED is lighted with a second color; and upon detecting a third state, the LED is alternately lighted with said first and said second colors at a sufficiently high rate to cause the color of the LED to appear as a third color.

4 Claims, 6 Drawing Sheets

TRI-STATE FUNCTION INDICATOR

RELATED APPLICATIONS

This application is related to the following applications filed on even date herewith, the disclosure of which is hereby incorporated by reference. These applications contain, at least in part, common disclosure regarding an embodiment of a peripheral repeater box. Each, however, contains claims to a different invention.

Peripheral Repeater Box Ser. No. 085,097
D.C. Power Monitor Ser. No. 085,095
Method of Changing Baud Rates Ser. No. 085,084
System Permitting Peripheral
Interchangeability Ser. No. 085,105
Communications Protocol Ser. No. 085,096
Method of Packetizing Data Ser. No. 085,098

BACKGROUND OF THE INVENTION

This invention relates to computer systems in general and more particularly, to a tri-state function indicator particularly useful in a computer system.

In large computer systems, and particularly in systems which provide graphics displays, a plurality of different types of peripheral devices for providing input to the computer system are provided. For example, a single system may have as inputs a keyboard, a mouse, a tablet, a light pen, dial boxes, switch boxes and so forth. In a system with a plurality of such peripherals it is advantageous to have a device which can collect inputs from each of these peripherals and then retransmit the various inputs over a single line to the computer system. Such a device is referred to herein as a peripheral repeater box in that it acts as a repeater for each of the individual peripherals.

Preferably, a peripheral repeater box of this nature, which will include its own processor, will be capable of running various levels of self test. Some indication should be given of the status of the peripheral repeater box, i.e. whether it is in a test mode or in an operating mode. Similar requirements for indicating status are found in other systems, particularly computer systems.

SUMMARY OF THE INVENTION

The present invention provides such a function indicator. The function indicator is disclosed in the setting of a peripheral repeater box. It will be recognized, however, that the tri-state function indicator of the present invention is equally applicable in many other settings.

The Peripheral Repeater box (PR Box) of the present invention is, first of all, used to allow the peripherals to be powered at the Monitor site. The PR box collects the various peripheral signals using, a conventional RS-232-C or RS-423 connection, from seven peripheral channels, which are then packetized and sent to a host, e.g. a computer and/or graphics control processor, using RS-232-C signals. Transmissions to the peripherals are handled in a like manner from the host, i.e., receiving packets from the host, unpacking the data and channeling data to an appropriate peripheral serial line unit (SLU).

The peripheral repeater box of the present invention is particularly suited for use in a graphics system of the type disclosed in copending Applications Ser. Nos. 084,930 and 085,081, entitled Console Emulation For A Graphics Workstation and High Performance Graphics Workstation, filed on even date herewith, the disclosure of which is hereby incorporated by reference.

In addition to providing a multiplexing/data concentration function for the peripherals, the PR box also implements a self-test check on its own logic (performed on power-up and on command request) and an external loopback function for manufacturing testing. The manufacturing test mode, which is an extended version of self-test, operates when the manufacturing jumper is detected in circuit. When in this mode the self-tests run continuously unless an error is detected at which time it will loop on the failing test. This mode requires a special loopback module.

A function LED and a group of 8 diagnostic LEDs are located on the back panel of the PR Box. The function LED is utilized to indicate which state the PR box is in, i.e., the function being performed. The current error status, if any, is reflected in the diagnostic LEDs. The diagnostic LEDs are also available to the host to provide additional status information in the case where the graphics system is unable to display messages on its video display. A command is available to the system by which to write an error code to the diagnostic display. In accordance with the present invention, the function LED is a tricolor LED permitting indication of one of three states of conditions of operation.

DETAILED DESCRIPTION

System Overview

Figure 1:
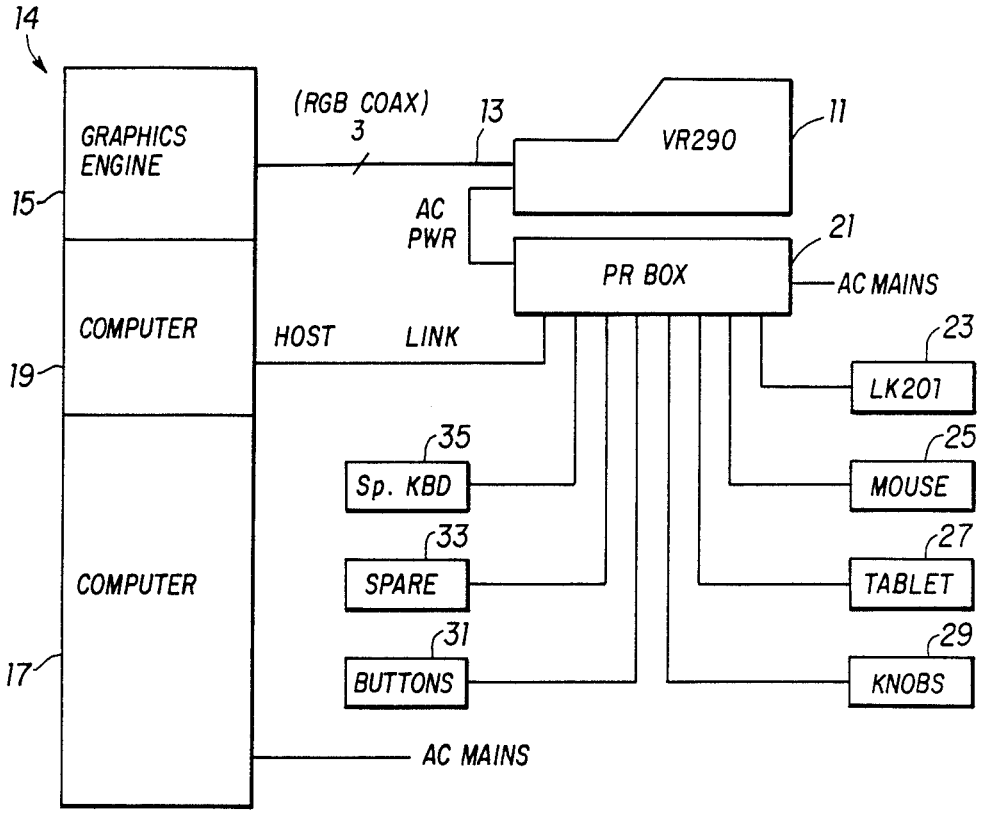
FIG. 1 is a block diagram of a computer system in which the PR box of the present invention may be used.

FIG. 1 is a block diagram of a computer system showing where the peripheral repeater box of the present invention fits into the system. The illustrated system is a graphics system. However, the present invention is applicable to other computer systems. Thus, there is illustrated a monitor 11 which receives video input from a RGB coax 13 which is coupled to computing apparatus 14 which does the graphic computations. Included in apparatus 14, as illustrated, is a graphics engine or graphics processor 15, a main computer 17, e.g. a Vax 8250 system, and a computer 19 acting as a control processor, which may be a Microvax computer. Computer 17 is host to computer 19 and computer 19 is host to the PR box 21 described below. Thus, hereinafter, where reference is made to a host, the reference is to computer 19. The operation of this part of the system is more fully described in Applications Ser. Nos. 084,930 and 085,081, entitled Console Emulation For A Graphics Workstation and High Performance Graphics Workstation, filed on even date herewith. The peripheral repeater box 21 is illustrated in FIG. 1 along with the various peripherals which may be plugged into it. These include a keyboard 23, a mouse 25, a tablet 27, knobs 29, i.e. a dial box, buttons 31, a spare RS232 channel 33 and a spare keyboard input 35.

The peripheral repeater box is a selfcontained microprocessor system which, in the illustrated embodiment, is located underneath the monitor. It is responsible for handling information flowing between the host and peripheral devices. This is a free running sub-system that performs a self-check of its own internal status at power up. After completing this task it initializes itself and continuously scans for activity from the host or peripherals.

Four peripheral channels (for keyboard 23, mouse 25, tablet 27 and knobs 29) and one command channel (for communications with the host) are provided to connect all the supported peripherals. In addition three spare channels for future expansion or special peripherals, e.g. the spare keyboard 35, button box 31, and spare 33 of FIG. 1 have been provided.

Figure 2:
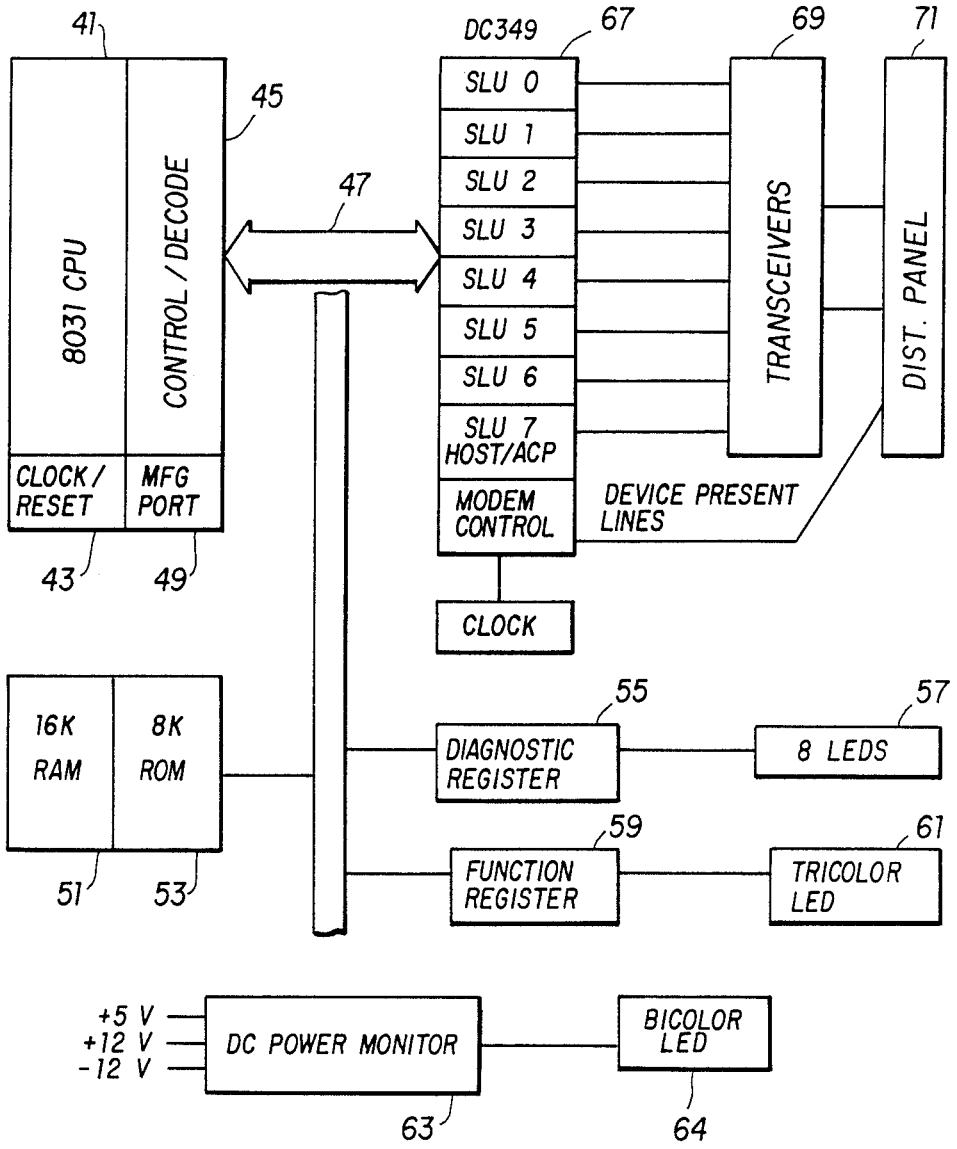
FIG. 2 is a basic block diagram of the PR box of the present invention.

The sub-system is composed of a minimal system as shown in FIG. 2. Thus, there is illustrated an 8031 microprocessor CPU 41 which, in conventional fashion, has a associated with it a clock/reset unit 43 with a 12 mHz crystal oscillator. Coupled to the 8031 CPU is a conventional control decode block 45 which couples the CPU to a bus 47. Bus 47 couples the CPU to memory 49 which includes 16K of RAM 51 and 8K of ROM 53. The 8031 has no on chip ROM and insufficient on chip RAM. For this reason, the 8031 is used in an expanded bus configuration utilizing three of the four available general purpose ports for address, data and control. These are coupled through block 45 to bus 47. Enabling the external addressing capability for the expanded bus configuration is accomplished by grounding (through a jumper) the EA, external access, pin.

The low order address and data are multiplexed on the 8031, the address is latched during address time with a 74LS373 Octal latch strobed via the ALE (address latch enable) signal output from the 8031.

Bus 47 is also connected to a diagnostic register 55. Diagnostic register provides an output to a display 57 comprising 8 LEDs. Also coupled to bus 47 is a function register 59 which provides its output to a tricolor LED 61 to be described in more detail below. Also shown in FIG. 2 is the DC power monitor 63 which provides its output to a bicolor LED 64 to indicate under or over voltage conditions as explained in detail below.

Bus 47 also connects to Serial Line Units (SLU) 0–7 along with a modem control contained in block 62. Block 62 is what is known as an octal asynchronous receiver/transmitter or Octalart. Such a device is manufactured by Digital Equipment Corporation of Maynard, MA. as a DC 349. Basically, the Octalart comprises eight identical communication channels (eight UARTS, in effect) and two registers which provide summary information on the collective modem control signals and the interrupting channel definition for interrupts. Serial line units 0–6 are coupled to the seven peripherals indicated in FIG. 1. SLU 7 is the host link shown in FIG. 1. The outputs of the SLUs are coupled through transceivers 69, the outputs of which in turn are connected to a distribution panel 71 into which the various connectors are plugged. Block 69 includes EIA Line drivers, 9636 type, operating off a bipolar supply of +/−12 volts which translate the signals from TTL levels to a bipolar RS-232-C compatible signal level of approximately +/−10 volts.

The host channel (SLU 7), keyboard channel and spare channel do not have device detection capability. The other five channels have an input line that is connected to the DCD (Data Carrier Detect) pin of the corresponding SLU of the Octalart 62. When the pin is at the channel connector side is grounded the input side of the Octalart is high indicating that a device is present on that channel.

A data set change summary register in block 62 will cause an interrupt if the status of one of these pins changes, i.e. high to low, or low to high level change. This indicates a device being added or removed after the system has entered operating mode. On power up the 8031 reads this register to determine which devices that have this capability are connected and enter this information into a configuration byte (a storage area in software) and is sent to the host as part of the self test report. This capability permits knowing which peripherals are connected to which ports and thus allows interchangeability of peripherals. The PR box, each time a peripheral is plugged in or unplugged, sends a message to the host allowing it to interrogate a peripheral and update a table which it maintains.

In the free running operational mode the PR box accepts data packets from the host through SLU 7 and verifies the integrity of that data. If the data is good then the PR box sends an ACK to the host, strips out the data or command from the packet and channels it to the designated peripheral through its associated SLU. If the data is bad, i.e. checksum error, the PR box sends a NAK to the host to request a re-transmission and throws away the packet it had received. These communications are described in detail below in connection with FIGS. 5C through 11C.

The PR box can also receive commands to test itself and report status/configuration to change the diagnostic LEDs and to change baud rates while in operational mode.

Self-test mode verifies the integrity of the microprocessor sub-system. After termination of the internal loopback of the Octalart, the sub-system will re-initialize itself and return to operational mode. Self-test is entered on power-up or by receipt of an executed self-test command from the host. This will check the functionality of the PR box logic.

An internal loopback sub-test is provided in the self-test, allowing the system to verify the integrity of the PR box logic under software control. While the self test is in operation there is no logical connection between the host and the PR box. This is true only during self-test. There is no effect on the peripherals when the PR box is running the internal loopback portion of self-test because no data is output at the transmit pins of the UART lines in Octalart 67. Additionally data coming in from the peripherals will have no effect on the PR box during loopback test since all data at the UART receive pins of Octalart 67 is ignored.

External loopback testing may be performed on an individual peripheral channel using the appropriate loopback on the channel to be tested. This is done from the host firmware. The peripheral repeater is transparent from this operation. This is the testing, explained further below which allows peripheral interchangeability.

A manufacturing test moded is provided by a jumper in the host channel loopback connector. This jumper is sensed on an 8031 on the power-up. In this mode the module runs all tests (as in self-test) on all channels and a device present test, and an external peripheral channel loopback test, continually. Loop on error functionality has been implemented to aid in repair.

The eight bit diagnostic register 55 with eight LEDs 57 attached provides the PR box status and some system status, (assuming some basic functionality of the main system). This register is used by the PR box to indicate its dynamic status during self-test or manufacturing test, to indicate, on entry to operational mode, any soft or hard error that may have occurred. The MSB, (bit 7) is used to indicate that a PR box error has occurred, bit 6 is used to indicate that a system error is displayed. If bit 6 is lit then the error code displayed is the system error, regardless of bit 7. This leaves 6 bits for providing encoded error responses.

The Function Monitor

As shown in FIG. 2, a tristate LED 61 is connected to the output of two bit function register 59. This is used to give visual indication of what mode or function the PR box is performing at that time.

| LED Indication | Description |
|---|---|
| Yellow | Self-test mode being executed |
| Red | Manufacturing test being performed |
| Green | Operational mode active |

Figure 3:
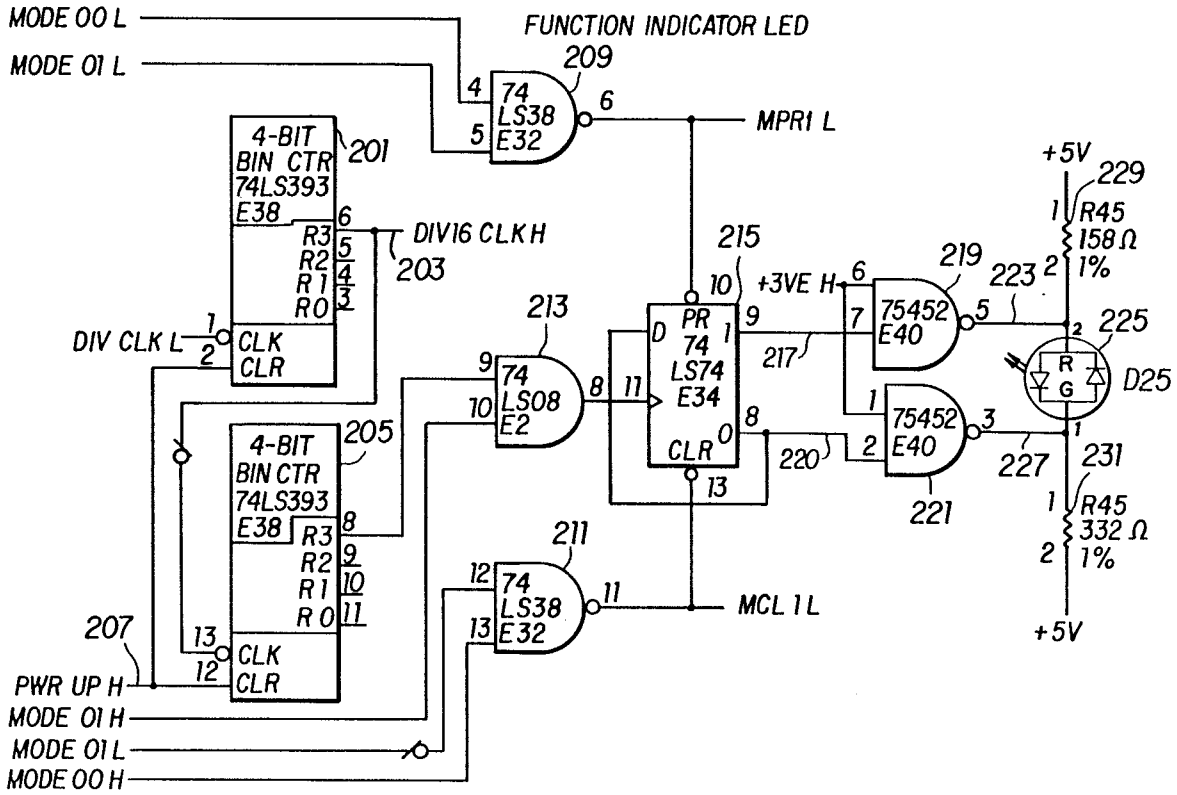
FIG. 3 is a schematic diagram of the function indicator LED of the present invention.

The circuit for driving, function indicator LED 61, is illustrated in FIG. 3. Register 59 indicates which function the PR box is currently performing, i.e. self-test, operation or manufacturing modes. It is a two bit register made up of a 74LS74 dual D type flip flop using 2 bits of a 74LS244 driver for read back. Each flip flop in the register has both a noninverted and an inverted output. Thus, the bit 0 flip flop provides a mode 00L signal and a mode 00H signal and the bit 1 flip flop a mode 01L signal and a mode 01H signal. The read back function has been added so that correct operation of the register hardware, exclusive of the LED can be checked automatically by the self-test software. The function is indicated by a single bicolor LED 61 operated in a tristate mode to produce three discrete colors.

A clock signal is provided as an input to a four-bit binary counter 201 to provide a divide by 16 clock output on output line 203. The output on line 203 is provided as an input to a second four-bit binary counter 205 where the signal is again divided by 16 to obtain a clock of approximately 19 KHz. Both counters 201 and 205 are cleared by a power up signal on line 207.

Signals mode 00 low and mode 01 low from function register 59 are provided as inputs to a Nand gate 209. Mode 00 corresponds to bit 1 and mode 01 to bit 2 of two bit register 59. Similarly, signals mode 01 low and mode 00 high are provided into a Nand gate 211. Mode 01 high is provided as an input to a Nand gate 213 which has as its second input the output of the binary counter 205. The output of this gate is the clock input to a D-type flip-flop 215. The "1" output of flip-flop 215 on line 217 is coupled as one input to Nand gate 219. The "0" output on line 220 is coupled as one input to Nand gate 221. These gate comprise a 75452 dual peripheral driver. The second input to Nand gates 219 and 221 is a three volt signal. The output of Nand gate 219 on line 223 is coupled to the red cathode of a bicolor LED 225. Similarly, the output on line 227 is coupled to its green cathode. Each of the cathodes is powered by plus 5 volts through resistors 229 and 231 respectively. These are open collector devices and thus the power for the LED is provided through the two resistors 229 and 231 tailored to operate the two LED sections at the same optical luminescence. Note that the heavier peripheral driver is required since, regardless of which LED is enabled, current flows through both resistors at all times.

In operation, if both modes 00 and mode 01 are low, the output of gate 209 will be a logic "1" and the flip-flop 215 will be preset thereby providing an output on line 217 which is coupled through Nand gate 219 to energize the red cathode of diode 225. If mode 01 is low and mode 00 is high an output from gate 211 will cause flip-flop 215 to be cleared and an output on line 221 will result causing the green cathode to be energized. If mode 01 is high then the clocking signal will be provided at the output of gate 213. Because mode 01 is high, neither Nand gate 209 or 211 will provide an output to cause the flip-flop 215 to be preset or cleared. In a D-type flip-flop, the clock signal will cause whatever is at the D input to be transferred to the "1" output. The D-input is tied to the "0" output on line 221. Thus, if, for example, line 221 is "0" then the "0" will be transferred to the "1" output on line 217 at which point line 221 will come to a logic "1" level. On the next clock cycle this logic "1" will be transferred to the "1" output on line 217. As a result, the red and green cathodes will be alternately energized and, because of the clock rate, it will appear to the observer to be the color yellow.

PE Box Operation Overview

Figure 4A:
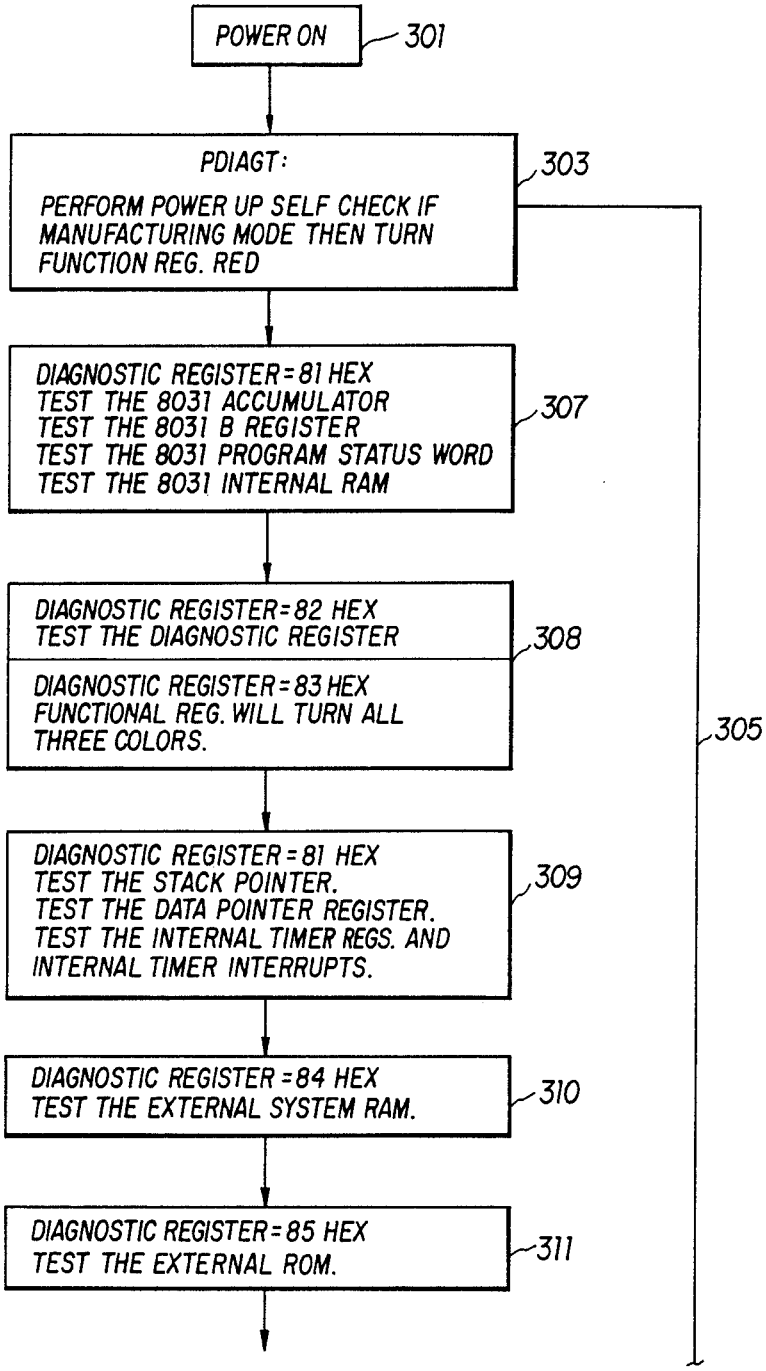
FIGS. 4A–C a flow diagram of the firmware running in the PR box of the present invention.
Figure 4B:
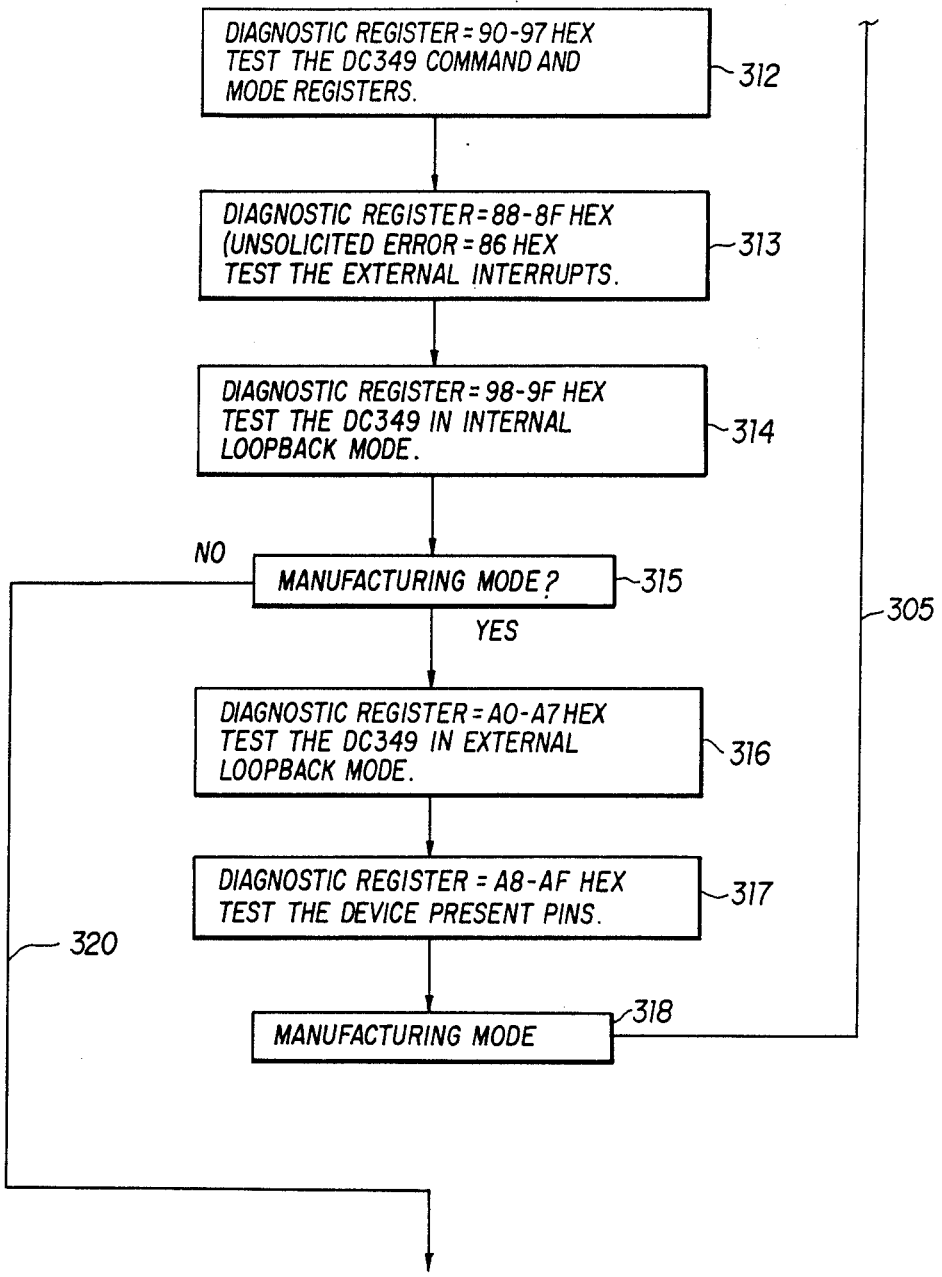

The PR box ROM 53 contains self-test and operational firmware. This firmware is contained in 4K bytes of ROM, though there is 8K bytes reserved for it. A listing of the firmware is set out in Appendix A. A flow diagram for the firmware is set out in FIGS. 4 and 4-A–C.

On power-up indicated by block 301, the on board diagnostics will have control of the PR box as indicated in block 303. The diagnostics will perform tests on the PR box logic and do an external loopback and test if pin 7 on the 8031 port 1 is grounded (signifying manufacturing mode). In manufacturing mode the diagnostics will loop forever via loop 305 and not go into operational mode. This is done via detection of the loopback connector (pin 7) on power up. If an error is encountered during manufacturing mode, the diagnostics will loop forever on the test that encountered the error.

Registers 55 and 59 with LEDs 57 and 61 (see FIG. 2) attached can be viewed from the outside of the system box. Diagnostic register 55 as noted above is 8 bits wide with Red LEDs. These LEDs report errors for the PR box and/or the system. As also described, the function register 59 is two bits wide with a single red/yellow/-green LED. When in manufacturing mode, the function LED is red as indicated in block 303. On power-up, during other than manufacturing mode, the function LED will be yellow. In operational mode it will be green.

The various tests performed on power up are indicated by blocks 307–314. If in manufacturing mode, as checked in block 315 of FIG. 5B, the test of blocks 316 and 317 are also performed before entering block 318 to loop 305.

If, on power up, the PR box has an error that will make the PR system unusable, i.e. interrupt, 8031 errors, the function LED will stay yellow, an attempt to put the error code in the diagnostic register will be made, and the PR box will not go into operational mode.

Figure 4C:
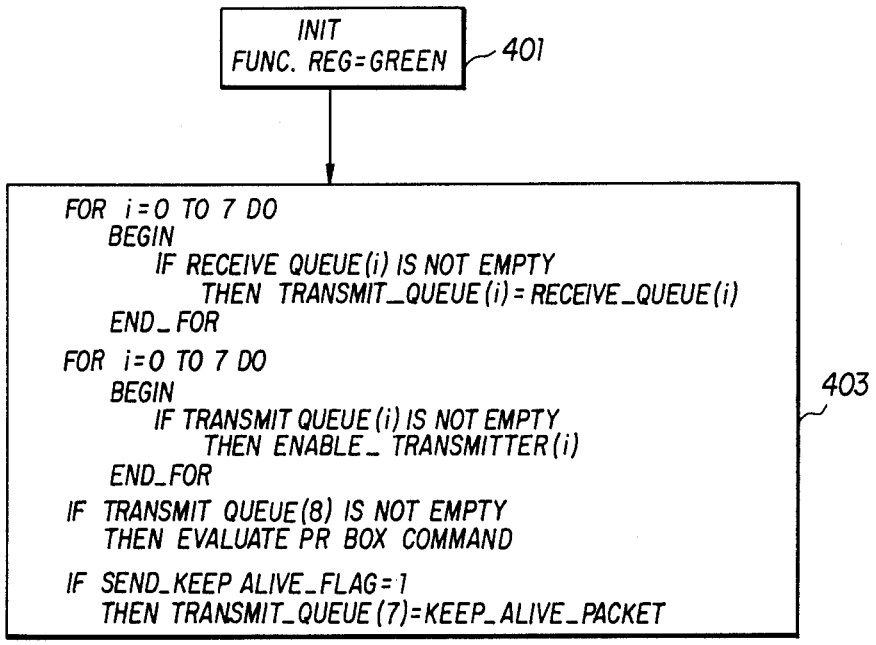

If there are no errors or errors that will not make the system unuseable, and the system is not in manufacturing mode, path 320 will be followed to block 401 of FIG. 4C and the function LED will turn green and wait for the host to ACK/NAK, the diagnostic report to establish the link between the host and the PR box. If the link is never established, the error code for NO host is placed into the diagnostic LEDs, and the PR box will go into operational mode. If the communications link is later established, the error code will be cleared.

If there are soft errors (diagnostic register or function register) the PR box will go into operational mode of FIG. 4C and carryout the background process. However, any LED indication may be incorrect. Except for a dead system, i.e. 8031 failures, the PR box will attempt to go operational mode, displaying , if possible, the point at which it failed the self-test, (test number).

After the power-up diagnostics have been completed, control is passed to the operational firmware. In this mode, the firmware will keep the link between the host and the PR box active, and mux/demux commands/-data between the peripherals and the host. This operation is described in detail below.

The diagnostics/operating system of this system are ROM based and run out of the 8031 microprocessor. The PR box firmware is compatible with the existing peripherals, and adheres to a communications protocol developed for the host PR box link discussed below.

The diagnostics are the first part of the firmware to run on power-up of the PR box. The diagnostics leave the system in a known state before passing control to the operating firmware. Upon completion of testing the PR box, the system RAM 51 is initialized, queues are cleared, the UARTs in Octalart 67 are set to the default speeds and data formats, the diagnostic and mode registers 55 and 57 are set with the appropriate values, and a system status area is set up that contains the status of the PR box.

Once the diagnostics are complete, the diagnostic report is sent to the host, and the PR box goes into operational mode. If there are no other messages to send, the PR box will wait 10 seconds for an ACK-/NAK before placing an error code for "No communications link" into the diagnostic register 55. An ACK-/NAK timer is provided for all other packets and times out at 20 mSec. Once operational, the UARTS are enabled to allow communications between the peripherals and the host. A keep-alive timer is also enabled in order to keep the host link active.

```
        TITLE   DIAGNOSTIC INTERRUPT ROUTINES

        RSECT   PRCODE
        INCLUDE MACRO.SRC
;
; COPYRIGHT (C) 1986
; DIGITAL EQUIPMENT CORPORATION, MAYNARD, MASSACHUSETTS 01754
;
; THIS SOFTWARE IS FURNISHED  UNDER A LICENSE FOR USE ONLY ON A SINGLE
; COMPUTER  SYSTEM AND  MAY BE  COPIED ONLY WITH  THE INCLUSION OF THE
; ABOVE COPYRIGHT NOTICE.  THIS SOFTWARE, OR ANY OTHER COPIES THEREOF,
; MAY NOT BE PROVIDED OR  OTHERWISE MADE AVAILABLE TO ANY OTHER PERSON
; EXCEPT FOR USE ON SUCH SYSTEM AND TO ONE WHO AGREES TO THESE LICENSE
; TERMS.  TITLE TO AND  OWNERSHIP OF THE  SOFTWARE  SHALL AT ALL TIMES
; REMAIN IN DEC.
;
; THE INFORMATION IN THIS SOFTWARE IS SUBJECT TO CHANGE WITHOUT NOTICE
; AND SHOULD  NOT BE CONSTRUED  AS A COMMITMENT  BY DIGITAL  EQUIPMENT
; CORPORATION.
;
; DEC ASSUMES  NO  RESPONSIBILITY  FOR  THE USE OR  RELIABILITY OF ITS
; SOFTWARE ON EQUIPMENT WHICH IS NOT SUPPLIED BY DEC.


        INTERN  TIM_SERV
        INTERN  UART_DIAGS

        EXTERN  CHANAD,CHANADR1,RX_ERROR
        EXTERN  TABLE
        EXTERN  END_TABLE
```

---

```
        PAGE

;*****************************************************************
;                                                                *
;                        TIMER_SERV                              *
;                                                                *
;*****************************************************************

TIM_SERV:

TI_0:           PUSH    ACC                     ;NO ME, SAVE ACC.
```

```
                INC     COUNT                   ;UPDATE INTERRUPT COUNT.
                MOV     A,COUNT                 ;GET TO ACC.
                CJNE    A,#04H,SERV_0           ;WAIT FOR 4 INTR.

                SETB    FLAG_1                  ;THEN SET USER FLAG.
                MOV     IE,#ZERO                ;DISABLE ALL INTERRUPTS.

SERV_0:         POP     ACC                     ;RETREIVE ACC.

                RETI                            ;RETURN.

        SUBTTL  UART_DIAGS


        PAGE

UART_DIAGS:
        PUSH    ACC
        PUSH    DPL
        PUSH    DPH
        PUSH    PSW
        MOV     PSW,#BANK_1             ; Set up the int. routine to use reg. ba
nk 1

READ_SUM:                               ; Read the summary register
        MOV     DPTR,#INT_SUM_REG
        MOVX    A,@DPTR                 ; Read the interrupt summary register
        JB      ACC.7,10$               ; If interrupt is from DC349, then conti
nue
        LJMP    INTR_ERROR              ; Indicate an unsolicited error

10$:    RRC     A                       ; Shift the lower bit out into the carry
 flag
        ANL     A,#0FH                  ; Mask out everything except for the por
t #
        MOV     R7,A                    ; Save the channel number in R7

        XRL     A,BNK0R7                ; Error if the current channel does not
equal reg 7
        JZ      5$                      ; OK, continue
        LJMP    INTR_ERROR

5$:     JNC     RX_DIAGS                ; If carry is not set, then receive a ch
aracter
        LJMP    TX_DIAGS                ; Else, transmit a character

RX_DIAGS:
        INC     R1                      ; Increment the int. routine table point
er
        CJNE    R1,#TABLE+END_TABLE-1H,10$ ; IS THIS THE LAST FOR THE CHANNEL?
        MOV     BNK0R3,#0AAH            ; Yes, set the indicator flag for end of
 channel tes
10$:    MOV     DPH,#ZERO
        MOV     DPL,R1                  ; Current data pattern to compare agains
t
        CLR     A
        MOVC    A,@A+DPTR
        MOV     R4,A                    ; Save the byte in Register 4
15$:    MOV     DPTR,#BASE_STATUS       ; Read the status for the byte received
        LCALL   CHANAD
        MOVX    A,@DPTR
                                        ; Check for errors
        JNB     ACC.5,20$               ; Framing error?
        ERRORA  15$,40$                 ; Yes, If manufacturing mode, keep readi
ng the statu
20$:    JNB     ACC.4,30$               ; Parity error?
        ERRORA  15$,40$                 ; Yes
30$:    JNB     ACC.3,40$               ; Overrun error?
        ERRORA  15$,40$                 ; Yes

40$:    MOV     DPTR,#BASE_RX           ; Set up to read the data byte
        LCALL   CHANAD
        MOVX    A,@DPTR                 ; Read the data byte
        XRL     A,R4                    ; Was it the byte that was expected?
        JZ      DIAG_INTR_RET
        SETB    ERROR_FLAG
        CLR     PASS_FAIL
```

```
DIAG_INTR_RET:
        POP     PSW                     ; Restore the register bank
        POP     DPH
        POP     DPL
        POP     ACC
        RETI



        PAGE

TX_DIAGS:
        SETB    TX_INTR                 ; Indicate we got an interrupt

; Turn off the interrupt for this channel before leaving
        MOV     P2,#IO_PAGE             ; Upper addr. for the DC349
        MOV     R1,#LOW BASE_CMD_R      ; Address to read the command register
        LCALL   CHANADR1                ; Adjust it to the appropriate channel

        MOVX    A,@R1                   ; Read the command register

        ANL     A,#NOT  TXIE_BIT        ; Clear the transmitter interrupt enable
 bit
        MOV     R1,#LOW BASE_CMD_W      ; Address to write the command resister
back
        LCALL   CHANADR1                ; Adjust it for this channel
        MOVX    @R1,A                   ; Write the register
        SJMP    DIAG_INTR_RET

INTR_ERROR:
        MOV     DPTR,#DIAG_REG
        MOV     A,#UNSOL_INTR
        MOVX    @DPTR,A                 ; Unsolicited interrupt error code
        CLR     PASS_FAIL               ; Clear the pass/fail bit to indicate fa
ilure
        SETB    ERROR_FLAG              ; Indicate an error was found
        JB      MAN_MODE,DIAG_INTR_RET  ; If not manuf. mode, return
        LJMP    READ_SUM                ; Otherwise loop on reading the status r
egister
;       END

        title POWERUP DIAGNOSTICS MAIN

; COPYRIGHT (C) 1986
; DIGITAL EQUIPMENT CORPORATION, MAYNARD, MASSACHUSETTS 01754
;
; THIS SOFTWARE IS FURNISHED  UNDER A LICENSE FOR USE ONLY ON A SINGLE
; COMPUTER  SYSTEM AND  MAY BE  COPIED ONLY WITH  THE INCLUSION OF THE
; ABOVE COPYRIGHT NOTICE.  THIS SOFTWARE, OR ANY OTHER COPIES THEREOF,
; MAY NOT BE PROVIDED OR  OTHERWISE MADE AVAILABLE TO ANY OTHER PERSON
; EXCEPT FOR USE ON SUCH SYSTEM AND TO ONE WHO AGREES TO THESE LICENSE
; TERMS.  TITLE TO AND  OWNERSHIP OF THE  SOFTWARE  SHALL AT ALL TIMES
; REMAIN IN DEC.
;
; THE INFORMATION IN THIS SOFTWARE IS SUBJECT TO CHANGE WITHOUT NOTICE
; AND SHOULD  NOT BE CONSTRUED  AS A COMMITMENT  BY DIGITAL  EQUIPMENT
; CORPORATION.
;
; DEC ASSUMES  NO  RESPONSIBILITY  FOR  THE USE OR  RELIABILITY OF ITS
; SOFTWARE ON EQUIPMENT WHICH IS NOT SUPPLIED BY DEC.
        page


        SUBTTL  START
        EXTERN  TIM_SERV,UART_SERVICE,MOVE_A,CHANAD,INIT,UART_DIAGS
        EXTERN  END_CODE,ENABLE_TX,RX_ERROR,TIMER0_INT,TIMER1_INT,CHANADR1
        EXTERN  WRITE_COMMAND

;*************************************************************************;
;*M                                                                      *;
;*      Jump Table                                                      *;
;*                                                                      *;
;*************************************************************************;

;;      SECT    CODE,ABS,LOC=0H ;
```

```
        RSECT   PRCODE
        include         MACRO.SRC
;
; COPYRIGHT (C) 1986
; DIGITAL EQUIPMENT CORPORATION, MAYNARD, MASSACHUSETTS 01754
;
; THIS SOFTWARE IS FURNISHED  UNDER A LICENSE FOR USE ONLY ON A SINGLE
; COMPUTER  SYSTEM AND  MAY BE  COPIED ONLY WITH  THE INCLUSION OF THE
; ABOVE COPYRIGHT NOTICE.  THIS SOFTWARE, OR ANY OTHER COPIES THEREOF,
; MAY NOT BE PROVIDED OR  OTHERWISE MADE AVAILABLE TO ANY OTHER PERSON
; EXCEPT FOR USE ON SUCH SYSTEM AND TO ONE WHO AGREES TO THESE LICENSE
; TERMS.  TITLE TO AND  OWNERSHIP OF THE  SOFTWARE  SHALL AT ALL TIMES
; REMAIN IN DEC.
;
; THE INFORMATION IN THIS SOFTWARE IS SUBJECT TO CHANGE WITHOUT NOTICE
; AND SHOULD  NOT BE CONSTRUED  AS A COMMITMENT  BY DIGITAL  EQUIPMENT
; CORPORATION.
;
; DEC ASSUMES  NO  RESPONSIBILITY  FOR  THE USE OR  RELIABILITY OF ITS
; SOFTWARE ON EQUIPMENT WHICH IS NOT SUPPLIED BY DEC.


        subttl  INTPT VECTORS

        page


;
;-----------------------------------------------------------------------
;
;       interrupt vectors and branch instructions
;
;-----------------------------------------------------------------------
;
;       sect    code,abs, loc = 0000h
;-----------------------------------------------------------------------
        org     0000h                   ; reset branch location
        ljmp    PDIAGT                  ; to start the diagnostics
;-----------------------------------------------------------------------
        org     0003h                   ; external interrupt 0
        jb      diag_test,10$           ; Diagnostics, use the diagnotic uart ro
utine
        LJMP    UART_SERVICE            ; service routine for the DC349 octauart
;-----------------------------------------------------------------------
        org     000bh                   ; timer 0 overflow interrupt
        JB      DIAG_TEST,20$           ; Diagnostics, go to diag intr. handler
        LJMP    TIMER0_INT              ; Timer handler for the operational code
;-----------------------------------------------------------------------
        org     0013h                   ; external interrupt 1
        LJMP    $                       ; No external interrupt 1
;-----------------------------------------------------------------------
        org     001bh                   ; timer 1 overflow interrupt
        JB      DIAG_TEST,20$           ; Diagnostics, go to diag intr. handler
        LJMP    TIMER1_INT              ; Timer handler for the operational code
;-----------------------------------------------------------------------
        org     0023h                   ; serial i/o interrupt
        SJMP    $                       ; Not used
;-----------------------------------------------------------------------
;
;       firmware interrupt routines
10$:    LJMP    UART_DIAGS      ; Uart routine for the diagnostics
20$:    LJMP    TIM_SERV        ,TEMP
;;30$:  ljmp    swintr
40$:    ljmp    TIM_SERV        ;TEMP
;;50$:  ljmp    uarts

TABLE:
        DB      06DH
        DB      0D6H
        DB      0B6H
        DB      0C3H
        DB      03CH
        DB      055H
        DB      0AAH
END_TABLE       EQU     $-TABLE
```

```
FIRMWARE_REV:   DB      REV_LEVEL       ; Firmware revision
MASK:   DB      55H                     ; Used for the DTPR test
DC_TST_PTRNS:                           ; Test patters for the DC349 registers
        DB      000H,055H,0AAH
        DB      0A5H,0AAH,055H

BAUD_TO_TIME:                           ; Table of time out values for baud rates from 5
0 to 19200
        DB      0FFH,0FFH,0D6H,0AAH,080H,040H,020H,010H

        DB      00CH,00AH,008H,006H,004H,002H,002H,002H


        subttl  PDIAGT

        page
;*****************************************************************
;*                                                               *
;* Name                 :  POWERUP_DIAGNOSTICS -- MAIN           *
;* Purpose              :  To run a sequence of tests during powerup or *
;*                         at the time of switch reset or by Host *
;*                         command to initialise the system.     *
;* Date                 :  1-JUN-86                              *
;* Input                :  Port 1 pin 7 - Low = Manufacturing mode *
;* Output               :                                        *
;* Called By            :                                        *
;* Variables Changed    :                                        *
;* Calls                :                                        *
;* Resources used       :                                        *
;* Reference            :  Diagnostics functional specifications *
;*****************************************************************


        page
        subttl DIAGS
        page



        INTERN  PDIAGT,BAUD_TO_TIME
        INTERN  TABLE
        INTERN  END_TABLE

        page


        subttl  PDIAGT

PDIAGT:
        CLR     PASS_FAIL               ; Assume failure till it passes
        CLR     EA                      ; disable all interrupts
        CLR     RS1                     ; register bank 0 is
        CLR     RS0                     ; selected

        CLR     A
        MOV     DPTR,#DIAG_REG          ; load led address
        MOVX    @DPTR,A                 ; Clear the LED's
                                        ; that diag. is running
        MOV     ERCODE,#0h              ; set no error
        CLR     ERROR_FLAG              ; Make sure the error flag is cleared
        SETB    DIAG_TEST               ; Indicate that we are in diagnostics

        JB      MAN_MODE,ACC_TEST       ; If it is not man. mode, go start testi
ng
        MOV     DPTR,#FUNCT_REG         ; Else set the function register to red
        MOVX    @DPTR,A                 ; and then start testing

        subttl  ACC_TEST

        page
```

```
;*****************************************************************
;                                                                 *
;       NAME: ACC_TEST                                            *
;                                                                 *
;  THIS MODULE TESTS THE ACCUMULATOR REGISTER USING THE FOLLOW -  *
;  ING BINARY PATTERNS:                                           *
;                                                                 *
;                  - 00000000                                     *
;                  - 01010101                                     *
;                  - 10101010                                     *
;                  - 11111111                                     *
;                                                                 *
;*****************************************************************

ACC_TEST:
                MOV     A,#I_8031_ERROR         ; LED pattern for the 8031 tests
(assumed wor
                MOV     DPTR,#DIAG_REG          ; Address of the Diagnostic reg
                MOVX    @DPTR,A                 ; Light the LED's

                MOV     A,#ZERO                 ;CLEAR THE ACCUMULATOR.
                CJNE    A,#ZERO,ACC_ERR         ;OK?? - No loop forever
ACC_1:          MOV     A,#FILL                 ;YES...SET ACCUMULATOR TO FF.
                CJNE    A,#FILL,ACC_ERR         ;OK?? - No loop forever
ACC_2:          MOV     A,#TP_1                 ;YES...PATTERN 1 TO ACC.
                CJNE    A,#TP_1,ACC_ERR         ;OK?? - No loop forever
ACC_3:          MOV     A,#TP_2                 ;YES...PATTERN 2 TO ACC.
                CJNE    A,#TP_2,ACC_ERR         ;OK?? - No loop forever
                SJMP    B_TEST                  ; Yes, end of ACC_TEST

ACC_ERR:        CLR     PASS_FAIL               ; Error was encountered
                SJMP    $                       ; Loop forever

        subttl  B_TEST

        PAGE
;*****************************************************************
;                                                                 *
;                              B_TEST                             *
;                                                                 *
;  THIS MODULE TESTS THE B REGISTER USING THE SAME PATTERNS AS    *
;  IN ACC_TEST. A MULTIPLICATION IS ALSO PERFORMED TO VERIFY      *
;  THIS REGISTER OPERATION.                                       *
;                                                                 *
;  PARAMETER(S): LED_STATUS - CURRENT STATE OF THE LEDS.          *
;                                                                 *
;*****************************************************************

B_TEST:
                MOV     B,#ZERO                 ; Zero the register.
                MOV     A,B                     ; Get b contents.
                CJNE    A,#ZERO,B_ERR           ; Loop forever if not ok.
B_1:            MOV     B,#TP_1                 ; Pattern 1 to b reg.
                MOV     A,B                     ; Get B.
                CJNE    A,#TP_1,B_ERR           ; Loop forever if not ok.
B_2:            MOV     B,#TP_2                 ; Pattern 2 to B reg.
                MOV     A,B                     ; Get B.
                CJNE    A,#TP_2,B_ERR           ; Loop forever if not ok.
B_3:            MOV     A,#40H                  ; Set ACC.
                MOV     B,#02H                  ; Set B reg.
                MUL     AB                      ; Multiply A and B.
                CJNE    A,#80H,B_ERR            ; Loop forever if not ok.
                SJMP    PSW_TEST

B_ERR:          CLR     PASS_FAIL               ; An error was encountered
                SJMP    $                       ; Loop forever

        SUBTTL  PSW_TEST

        PAGE
;*****************************************************************
;                                                                 *
;                              PSW_TEST                           *
;                                                                 *
;  THIS ROUTINE VERIFIES THE OPERATION OF THE PROCESSOR STATUS    *
;  WORD BY DIRECT MANIPULATION OF THE ADDRESS WITH DATA PATTERNS  *
```

```
;  AND INDIRECTLY BY USING VARIOUS INSTRUCTIONS THAT CHANGE THE  *
;  STATE OF THE SYSTEM FLAGS (CY,AC,OV,P,RS0,RS1).               *
;
;*****************************************************************

PSW_TEST:       MOV     A,#ZERO                 ;CLEAR PARITY FROM LAST.
                MOV     PSW,#ZERO               ;CLEAR PSW.
                MOV     A,PSW                   ;GET CONTENTS OF PSW.
                CJNE    A,#ZERO,PSW_ERR         ;IF NOT ZERO, LOOP FOREVER
PSW_0:          MOV     PSW,#TP_1               ;SET TO ALT 1'S AND 0'S.
                MOV     A,PSW                   ;GET CONTENTS OF PSW.
                SETB    ACC.0                   ;PUT BACK PARITY.
                CJNE    A,#TP_1,PSW_ERR         ;LOOP FOREVER IF NOT SAME.
PSW_1:          MOV     PSW,#TP_2               ;ALTERNATE 1'S AND 0'S.
                MOV     A,PSW                   ;GET PSW CONTENTS.
                CJNE    A,#TP_2,PSW_ERR         ;LOOP FOREVER IF NOT SAME.
PSW_2:          CLR     C                       ;CLEAR THE CARRY.
                MOV     A,#0BFH                 ;ACC. = 10111111B.
                ADD     A,#81H                  ;ADD    10000001B.
                JNC     PSW_ERR                 ;LOOP FOREVER IF CARRY CLEAR.
PSW_3:          SETB    C                       ;SET THE CARRY.
                CLR     OV                      ;CLEAR OV FLAG.
                MOV     A,#07FH                 ;ACC. = 01111111B.
                ADD     A,#01H                  ;ADD    00000001B.
                JNB     OV,PSW_ERR              ;LOOP FOREVER IF OV CLEAR.
                JC      PSW_ERR                 ;LOOP FOREVER IF CARRY SET.
PSW_4:          CLR     AC                      ;CLEAR AC BIT.
                MOV     A,#0FH                  ;ACC. = 00001111B
                ADD     A,#01H                  ;ADD    00000001B.
                JNB     AC,PSW_ERR              ;LOOP FOREVER IF AC CLEAR.
PSW_5:          MOV     A,#0FH                  ;ACC. = 00001111B.
                JB      P,PSW_ERR               ;LOOP FOREVER IF PARITY SET.
PSW_6:          SETB    C                       ;SET THE CARRY.
                SUBB    A,#ZERO                 ;SUBTRACT 1.
                JNB     P,PSW_ERR               ;LOOP FOREVER IF PARITY CLEAR.
PSW_7:          SETB    PSW.4                   ;SELECT REG.....
                SETB    PSW.3                   ;... BANK 3.
                MOV     18H,#TP_1               ;SET PAT IN R0.
                MOV     A,R0                    ;SEE IF R0 CORRECT.
                CJNE    A,#TP_1,PSW_ERR         ;LOOP FOREVER IF R0 WRONG.
PSW_8:          CLR     PSW.4                   ;SELECT REG ...
                CLR     PSW.3                   ;... BANK 0.
                MOV     00H,#TP_2               ;SET PAT IN R0.
                MOV     A,R0                    ;SEE IF R0 CORRECT.
                CJNE    A,#TP_2,PSW_ERR         ;LOOP FOREVER IF R0 WRONG.
PSW_9:          MOV     00H,#ZERO               ;CLEAR R0.
                MOV     A,R0                    ;CHECK R0.
                CJNE    A,#ZERO,PSW_ERR         ;LOOP FOREVER IF NOT CORRECT.
PSW_10:         MOV     00H,#TP_1               ;SET R0.
                MOV     A,R0                    ;CHECK R0.
                CJNE    A,#TP_1,PSW_ERR         ;LOOP FOREVER IF NOT CORRECT.
                SJMP    RAM_TEST                ; End of the PSW test

PSW_ERR:        CLR     PASS_FAIL               ; An error was encountered
                SJMP    $                       ; Loop forever

        subttl  RAM_TEST

        PAGE

;*****************************************************************
;                                                                *
;                          RAM_TEST                              *
;                                                                *
;  THIS MODULE TEST THE INTERNAL DATA RAM (02H-7FH). 00H AND     *
;  01H HAVE ALREADY BEEN VERIFIED. ZERO AND 2 ALTERNATING 1'S    *
;  0'S PATTERNS WERE USED. A WALKING "1" AND WALKING "0" TEST    *
;  TEST IS DONE AS WELL.                                         *
;                                                                *
;*****************************************************************

RAM_TEST:       MOV     R0,#BOT_IRAM            ;ADDRESS 00 TO R0.
RAM_0:          MOV     @R0,#ZERO               ;CLEAR ADDRESS.
                MOV     A,@R0                   ;GET CONTENTS INTO ACC.
                CJNE    A,#ZERO,RAM_ERR         ;LOOP FOREVER IF NOT OK.
                INC     R0                      ;GET NEXT ADDRESS.
```

```
                CJNE    R0,#TOP_IRAM+01H,RAM_0   ;LOOP IF NOT DONE.
                DEC     R0                       ;ADJUST ADDRESS POINTER.
RAM_1:          SETB    C                        ;WALK A "1".
                MOV     R1,#09H                  ;R1 IS BIT COUNTER.
RAM_2:          MOV     A,@R0                    ;GET CONTENTS OF @R0.
                RRC     A                        ;ROTATE BY ONE BIT.
                XCH     A,@R0                    ;UPDATE ADDRESS.
                DJNZ    R1,RAM_2                 ;LOOP IF NOT DONE.
                JNC     RAM_ERR                  ;LOOP ERROR IF C=0.
                MOV     @R0,#TP_1                ;ELSE SET TO TP_1.
                DEC     R0                       ;DO NEXT ADDRESS.
                CJNE    R0,#BOT_IRAM-01H,RAM_1   ;LOOP IF NOT DONE.
                INC     R0                       ;ADJUST ADDRESS.
RAM_3:          MOV     A,@R0                    ;GET DATA IN ADDESS.
                CJNE    A,#TP_1,RAM_ERR          ;LOOP FOREVER IF NOT EQUAL.
                MOV     @R0,#TP_2                ;ELSE UPDATE TO TP_2.
                INC     R0                       ;GET NEXT ADDRESS.
                CJNE    R0,#TOP_IRAM+01H,RAM_3   ;LOOP IF NOT DONE.
                DEC     R0                       ;ADJUST ADDRESS.
RAM_4:          MOV     A,@R0                    ;GET DATA IN ADDRESS.
                CJNE    A,#TP_2,RAM_ERR          ;LOOP FOREVER IF DATA NOT EQUAL.
                MOV     @R0,#FILL                ;ELSE SET RAM ADDRESS.
                DEC     R0                       ;GET NEXT ADDRESS.
                CJNE    R0,#BOT_IRAM-01H,RAM_4   ;LOOP IF NOT DONE.
                INC     R0                       ;ADJUST ADDRESS.
RAM_5:          CLR     C                        ;WALK A "0".
                MOV     R1,#09H                  ;SET BIT COUNTER.
RAM_6:          MOV     A,@R0                    ;GET DATA IN ADDRESS.
                CJNE    A,#FILL,RAM_ERR          ;LOOP FOREVER IF NOT EQUAL.
RAM_7:          MOV     A,@R0                    ;GET DATA IN ADDRESS.
                RLC     A                        ;ROTATE LEFT.
                XCH     A,@R0                    ;UPDATE ADDRESS.
                DJNZ    R1,RAM_7                 ;LOOP IF NOT DONE.
                JC      RAM_ERR                  ;LOOP FOREVER ERROR IF C=1.
                MOV     @R0,#ZERO                ;CLEAR ADDRESS.
                INC     R0                       ;GET NEXT ADDRESS.
                CJNE    R0,#TOP_IRAM+01H,RAM_5   ;LOOP IF NOT DONE.
                SJMP    D_REG_TEST               ; End of the internal RAM test

RAM_ERR:        CLR     PASS_FAIL                ; An error was encountered
                SJMP    $                        ; Loop forever

        SUBTTL D_REG_TEST

        PAGE

;*****************************************************************************
;
;       NAME:   D_REG_TEST
;
;       DESCRIPTION: This test will test for shorts and opens on the DIAGNOSTIC
;                    register.
;
;       INPUT: NONE
;
;       OUTPUT: NONE
;
;*****************************************************************************

D_REG_TEST:
        MOV     P2,#HIGH DIAG_REG       ; High order address of the diagnostic r
egister
        MOV     R0,#LOW DIAG_REG        ; Low order address of the diagnostic re
gister
        MOV     DPTR,#TABLE             ; Addr. of a table of patterns
        MOV     R1,#END_TABLE           ; Length of the table

10$:    CLR     A                       ; Clear out the accumulator
        MOVC    A,@A+DPTR               ; Get the test byte from the table
        MOV     R2,A                    ; Save it in R2
        MOVX    @R0,A                   ; Send the byte to the register
        MOVX    A,@R0                   ; Read it back
        XRL     A,R2                    ; See if they are equal
        JZ      20$                     ; They are, continue

        CLR     PASS_FAIL               ; Indicate a failure
        MOV     ERCODE,#DIAG_REG_ERROR  ; Save the error code
        JB      MAN_MODE,END_DTEST      ; Not manufacturing mode, go to the end
of the test
        SETB    ERROR_FLAG              ; It is man. mode, set the error bit
        SJMP    10$                     ; And loop on error
```

```
20$:    INC     DPTR                    ; Point to the next test pattern
        DJNZ    R1,10$                  ; Loop if we are not done with the table
END_DTEST:
        LOOPCHK D_REG_TEST              ; Check for looping conditions in manufa
cturing mode
LCL     SET     $

        SUBTTL  FUNCT_REG_TEST

        PAGE
;;;
```

```
        MOVX    @DPTR,A
20$:    MOV     DPTR,#DIAG_REG          ; Address of the diagnostic register
        MOV     A,#I_8031_ERROR         ; Put the error code for an 8031 back in
 the leds
        MOVX    @DPTR,A

        SUBTTL  STACK_TEST

        PAGE

;*****************************************************************
;                                                                *
;                          STACK_TEST                            *
;                                                                *
;  THIS TEST VERIFIES THE OPERATION OF THE STACK POINTER BY      *
;  USING THE "PUSH" AND "POP" INSTRUCTIONS. THE REGISTER IS      *
;  ALSO MESSAGED DIRECTLY WITH DATA PATTERNS TO CHECK FOR        *
;  SHORTS AND OPEN PATHS.                                        *
;                                                                *
;  THE STACK IS ALSO INITIALIZED TO THE END OF INTERNAL MEMORY.  *
;                                                                *
;*****************************************************************

STACK_TEST:     MOV     SP,#03H                 ;SET THE SP.
                PUSH    ACC                     ;INC THE SP.
                MOV     A,SP                    ;GET SP VALUE.
                CJNE    A,#03H+01H,STA_ERR      ;LOOP FOREVER IF NOT OK.
STA_0:          MOV     SP,#TP_1                ;PATTERN TO SP.
                POP     ACC                     ;DEC THE SP.
                MOV     A,SP                    ;READ IT.
                CJNE    A,#TP_1-01H,STA_ERR     ;LOOP FOREVER IF NOT OK.
STA_1:          MOV     SP,#2AH                 ;NEXT PATTERN TO SP.
                PUSH    ACC                     ;INC THE STACK.
                MOV     A,SP                    ;READ IT.
                CJNE    A,#2AH+01H,STA_ERR      ;LOOP FOREVER IF NOT OK.
STA_2:          MOV     SP,#SPS                 ;SET THE STACK.
                PUSH    ACC                     ;INC THE SP.
                MOV     A,SP                    ;GET SP.
                CJNE    A,#SPS+01H,STA_ERR      ;LOOP FOREVER IF NOT OK.
                POP     ACC                     ;DEC THE SP.
                MOV     A,SP                    ;GET SP.
                CJNE    A,#SPS,STA_ERR          ;LOOP FOREVER IF NOT OK.
                SJMP    ADDR_TEST               ; End of the stack test

STA_ERR:        CLR     PASS_FAIL               ; An error was encountered
                SJMP    $                       ; Loop forever

        subttl  ADDR_TEST

        PAGE

;*****************************************************************
;                                                                *
;                          ADDR_TEST                             *
;                                                                *
;  THIS TEST VERIFIES THAT THE "DPL" AND "DPH" REGISTERS WORK    *
;  PROPERLY WHEN WRITTEN TO. ALTERNATING DATA PATTERNS ARE USED  *
;  TO MAKE THE VERIFICATION. ONCE THESE REGISTERS ARE FOUND TO   *
;  BE OK, WE LOAD THESE REGISTERS WITH THE ADDRESS OF THE USER   *
;  TEST "MASK" DATA REGISTER IN PROGRAM MEMORY TO DETERMINE IF   *
;  THE CORRECT ADDRESS WAS ACCESSED USING THE FOLLOWING          *
;  INSTRUCTION:                                                  *
;                                                                *
;               MOVC    A,@A+DPTR                                *
;                                                                *
;  PARAMETER:   MASK    - PREDEFINED NUMBER = 55H                *
;                                                                *
;*****************************************************************

ADDR_TEST:      CLR     ERROR_FLAG              ; Clear the error flag on enteri
ng this test
                MOV     DPL,#ZERO               ;CLEAR ADDRESS.
                MOV     DPH,#ZERO               ;THIS ONE, TOO.
                MOV     R0,DPL                  ;GET DATA IN ADDRESS.
                MOV     R1,DPH                  ;HERE, TOO.
                CJNE    R0,#ZERO,ADDR_ERR       ;LOOP FOREVER IF NOT OK.
                CJNE    R1,#ZERO,ADDR_ERR       ;HERE, TOO.
```

```
ADDR_0:         MOV     DPL,#TP_1               ;SET DPL.
                MOV     DPH,#TP_1               ;SET DPH.
                MOV     R0,DPL                  ;GET CONTENTS.
                MOV     R1,DPH                  ;HER, TOO.
                CJNE    R0,#TP_1,ADDR_ERR       ;LOOP FOREVER IF NOT OK.
                CJNE    R1,#TP_1,ADDR_ERR       ;HERE, TOO.
ADDR_1:         MOV     DPL,#TP_2               ;SET DPL.
                MOV     DPH,#TP_2               ;SET DPH.
                MOV     R0,DPL                  ;GET CONTENTS.
                MOV     R1,DPH                  ;HERE, TOO.
                CJNE    R0,#TP_2,ADDR_ERR       ;LOOP FOREVER IF NOT OK.
                CJNE    R1,#TP_2,ADDR_ERR       ;HERE, TOO.
                ;
ADDR_3:         MOV     DPTR,#MASK              ;USE COUNT TO TEST.
                CLR     A                       ;NEED TO DO.
                MOVC    A,@A+DPTR               ;GET VALUE IN COUNT.
                XRL     A,#TP_1                 ; Compare the value
                JZ      ADDR_END                        ; It was ok
                CLR     PASS_FAIL               ; Indicate the error
                SETB    ERROR_FLAG              ; Set the error flag
                SJMP    ADDR_3                  ; And loop

                                                ; End of the addressing test
ADDR_END:       JB      ERROR_FLAG,ADDR_3       ; If there was an error loop on
the data poi
                SJMP    TIMER_TEST

ADDR_ERR:       CLR     PASS_FAIL               ; An error was encountered
                SJMP    $                       ; Loop forever

        SUBTTL  TIMER_TEST

        PAGE

;*************************************************************
;                                                           *
;                        TIMER_TEST                         *
;                                                           *
;  THIS MODULE TEST BOTH TIMER_0 AND TIMER_1 USING INTERRUPTS.  *
;  THE TEST WILL LOOP FOREVER IF THE INTERRUPTS AREN'T RESPONDED *
;  TO; THEREFORE, THE LEDS WILL STAY ON INDICATING A COMPUTER   *
;  (8051) ERROR WHICH IS WHERE THE TIMERS RESIDE.               *
;  IN ADDITION THE "TH0","TL0","TH1", AND "TL1" REGISTERS ARE   *
;  TESTED FOR SHORTS OR OPENS.                                  *
;                                                               *
;  PARAMETERS:  NONE.                                           *
;                                                               *
;*************************************************************

TIMER_TEST:     SETB    DIAG_TEST               ; Indicate we're in diagnostics
                CLR     TR0                     ;TURN OFF TIMER 0.
                CLR     TR1                     ;AND TIMER 1.
                MOV     IE,#ZERO                ;DISABLE ALL INTERRUPTS.
                MOV     TMOD,#00100010B         ;SET TIMERS FOR MODE 2.

TIM_0:          MOV     A,#ZERO                 ;SHIFT A ZERO PATTERN.
                CALL    MOVE_A                  ;DO SHIFT THRU TIMER REG.
                CJNE    A,#ZERO,TIM_ERR         ;LOOP FOREVER IF NOT OK.
TIM_1:          MOV     A,#TP_1         ;PUT PATTERN 1.
                CALL    MOVE_A                  ;SHIFT.
                CJNE    A,#TP_1,TIM_ERR         ;LOOP FOREVER IF NOT OK.
TIM_2:          MOV     A,#TP_2         ;PUT PATTERN 2.
                CALL    MOVE_A                  ;SHIFT.
                CJNE    A,#TP_2,TIM_ERR         ;LOOP FOREVER IF NOT OK.

                MOV     COUNT,#ZERO             ;ZERO THE COUNT.
                MOV     TH0,#0FEH               ;SET RE-LOAD VALUE.
                MOV     TL0,#0FEH               ;SET THIS. (Intr. after 2 ticks)
                CLR     FLAG_1                  ;CLEAR USER FLAG.
                SETB    IE.7                    ;ENABLE INTERRUPTS.
                SETB    IE.1                    ;ENABLE TIMER 0.
                SETB    TR0                     ;RUN TIMER 0.

                MOV     R0,#6                   ; Time out value
TIM_3:          JB      FLAG_1,10$              ; Got the intr, continue
                DJNZ    R0,TIM_3                ; Wait for the intr
                SJMP    TIM_ERR                 ; Time out
```

```
10$:            CLR     TR0                     ; Turn off timer zero
                MOV     COUNT,#ZERO             ;RESET THE COUNT.
                MOV     TH1,#0FEH               ;SET RE-LOAD VALUE.
                MOV     TL1,#0FEH               ;SET THIS, TOO.
                CLR     FLAG_1                  ;CLEAR USER FLAG.
                SETB    IE.7                    ;ENABLE INTERRUPTS.
                SETB    IE.3                    ;ENABLE TIMER 1.
                SETB    TR1                     ;RUN TIMER 1.

                MOV     R0,#6                   ; Time out value
TIM_4:          JB      FLAG_1,20$              ; Got the intr.
                DJNZ    R0,TIM_4                ; Wait for the flag
                SJMP    TIM_ERR                 ; time out error

20$:            CLR     TR1
                SJMP    DRAMXT                  ; End of the timer test

TIM_ERR:        CLR     PASS_FAIL               ; An error was encountered
                SJMP    $                       ; Loop forever

        subttl  DRAMXT


        page
;*****************************************************************************
;
;       TITLE:  DRAMXT
;
;       DESCRIPTION: This routine will test the external RAM of the PR Box.
;                    It will do this in a 4 pass test.  The first pass will
;                    fill all of RAM with the pattern 55.  The second pass
;                    will read/compare, compliment, and write back the pattern
;                    AA.  The third pass will read/compare and clear memory.
;                    The fourth pass will compare memory to  zero, and do a
;                    walking one's pattern every 256 bytes.
;
;       INPUT:  NONE
;
;       OUTPUT: LED PATTERN FOR RAM TEST/ERROR
;
;*****************************************************************************

DRAMXT:                                         ; TEST EXTERNAL RAM

        MOV     A,#XRAM_ERROR                   ; Put the error code for a ram test
        MOV     DPTR,#DIAG_REG                  ; on the LED's
        MOVX    @DPTR,A

        MOV     DPTR, #LAST_RAM                 ; Load address of the last 256 byte bloc
k
                                                ; of RAM

                                                ; loop for testing 256 bytes of block
                                                ; at a time
10$:
        MOV     A, #TP_1                        ;Test pattern=55H (01010101)
        MOVX    @DPTR, A                        ;Write test pattern to memory

        DJNZ    DPL, 10$                        ; GO FROM XX00,XXFF TO XX01 LOCATION
                                                ; next 256 bytes
        DEC     DPH
        MOV     A, DPH
        CJNE    A,#PAST_RAM, 10$                        ; go for the next block in the

        INC     DPH                             ; Re-adjust the data pointer


20$:    MOVX    A, @DPTR                        ; Read back to test
        XRL     A,#TP_1                         ; Check if r/w is good
        JZ      25$                             ; Compare was good
        ERROR   20$                             ; Error in RAM location

25$:    MOV     A,#TP_2                         ; Set up for the next pattern (0AA hex)
        MOVX    @DPTR, A                        ; Write test pattern
        INC     DPTR                            ; Point to next RAM location
        MOV     A,DPL
```

```
        CJNE    A,#ZERO,20$             ; Check for the end of ram
        MOV     A,DPH
        CJNE    A,#HIGH TOP_RAM+1,20$ ; 1 byte past the end of ram?

        MOV     DPTR,#TOP_RAM           ; Re-adjust for the top of RAM

30$:    MOVX    A, @DPTR                ; Read back to test
        XRL     A,#TP_2                 ; Check if r/w is good
        JZ      35$                     ; Compare was good
        ERROR   30$                     ; Error in RAM location

35$:    MOVX    @DPTR,A                 ; Clear the memory location

        DJNZ    DPL,30$                 ; Point to the next location
        MOV     A,#1                    ; Every 256 bytes, do a walking ones tes
t
40$:    MOV     R0,A                    ; Save the current pattern
        MOVX    @DPTR,A                 ; Write the pattern out to memory
        MOVX    A,@DPTR                 ; Read it back
        XRL     A,R0                    ; Error if patterns aren't the same
        JZ      45$                     ; Compare was good
        MOV     A,R0                    ; Restore the accumulator
        ERROR   40$                     ; Error in RAM location

45$:    MOV     A,R0                    ; Restore the accumulator
        RLC     A                       ; Check the next bit
        JNC     40$                     ; Not done yet
        MOVX    @DPTR,A                 ; Done, clear that memory location
        DEC     DPH                     ; Go do the next 256 byte block
        MOV     A,DPH
        CJNE    A,#PAST_RAM,30$         ; Unless we are done with all of ram

; Fourth and final pass - making sure memory was written with all zeros
        INC     DPH                     ; Re-adjust the data pointer
50$:    MOVX    A, @DPTR                ; Read a byte to test
        XRL     A,#ZERO                 ; Check if the r/w is good
        JZ      55$                     ; Compare was good
        ERROR   50$                     ; Error in RAM location

55$:    INC     DPTR                    ; Point to next RAM location
        MOV     A,DPL
        CJNE    A,#ZERO,50$             ; Check for the end of ram
        MOV     A,DPH
        CJNE    A,#HIGH TOP_RAM+1,50$   ; 1 byte past the end of ram? Loop if no
t
; Done with ram test

                        ; Loop if in man. mode and there was an intermittant err
or
        JB      MAN_MODE,DROMT
        JNB     ERROR_FLAG,DROMT
        LJMP    DRAMXT


        subttl DROMT


        page

;*********************************************************************
;
;       NAME: DROMT
;
;       DESCRIPTION: This test will do a checksum on the ROM.
;
;       INPUT: NONE
;
;       OUTPUT: NONE
;
;*********************************************************************

DROMT:
        MOV     A,#ROM_ERROR            ; Pattern to light the LED's with
        MOV     DPTR,#DIAG_REG          ; Address of the LED's
        MOVX    @DPTR,A                 ; Light the LED's

        MOV     DPTR,#ZERO              ; Start with the beginning of rom
        MOV     R2,#ZERO                ; Start with sum = 0
```

```
10$:    CLR     A                       ; Index for fetching code bytes using th
e DPTR
        MOVC    A,@A+DPTR               ; Code fetched from 0000 to the end of c
ode space

        ADD     A,R2                    ; Add in the partial sum
        RL      A                       ; Rotate the checsum (Bit 7 -> Bit 0)
        MOV     R2,A                    ; Save the partial sum
        INC     DPTR                    ; Increment to fetch the next code byte

        MOV     A,DPL                   ; Check for the end of code space
        CJNE    A,#LOW END_CODE,10$     ; Not at the end of code, add in the nex
t byte
        MOV     A,DPH                   ; Low addr was equal, is the upper addr?
        CJNE    A,#HIGH END_CODE,10$    ; No, add in the next block of code byte
s
                                        ; Yes, time to check the checksum
        MOV     DPTR,#CHKSUM_ADDR       ; Get the address of the checksum byte
        CLR     A                       ; Clear A to use as an index for a code
byte fetch
        MOVC    A,@A+DPTR               ; Fetch the checksum from ROM

        SUBB    A,R2                    ; Subtract the calculated checksum
        JZ      20$                     ; Passed, go to end of routine
        ERROR   DROMT                   ; If A<>zero then loop on error for man.
 mode

20$:    LOOPCHK DROMT                   ; Check for intermittant error in Man. m
ode


        subttl  DC_REG_TEST

        PAGE
;;;
```

```
        DEC     R1                      ; Point to the Mode register read addres
s
        INC     DPTR                    ; Point to the data for Mode reg 1
40$:    MOV     A,#ZERO
        MOVC    A,@A+DPTR               ; Get the test byte
        MOVX    @R0,A                   ; Send the byte to Mode reg 1
        MOV     R2,A                    ; Save it for a comparison later
        INC     DPTR                    ; Point to the data for Mode reg 2
        MOV     A,#ZERO
        MOVC    A,@A+DPTR               ; Get the byte
        MOVX    @R0,A                   ; Send it (Mode 1 and 2 are at the same
address)
        MOV     R3,A                    ; Save it for a comparison


        MOVX    A,@R1                   ; Read back mode reg 1 (mode reg. pointe
r automatica
        XRL     A,R2                    ; Compare it with the pattern that was s
ent
        JZ      50$                     ; No error, continue
        DEC     DPL                     ; Re- adjust the data pointer on error
        DEC     DPL                     ; Re- adjust the data pointer on error
        ERROR   20$                     ; Error in the MODE REGISTER (go back to
 this channe

50$:    MOVX    A,@R1                   ; Read back mode reg 2 (mode reg. pointe
r automatica
        XRL     A,R3                    ; Compare it with the pattern that was s
ent
        JZ      60$                     ; No error, continue
        DEC     DPL                     ; Re- adjust the data pointer on error
        DEC     DPL                     ; Re- adjust the data pointer on error
        ERROR   20$                     ; Error in the MODE REGISTER (go back to
 this channe

60$:    INC     DPTR                    ; point to the next set of test patterns
        INC     R0                      ; Reset the pointers to the command reg
        INC     R1
        DJNZ    R4,20$                  ; Send the next set of test patterns
                                        ; Finished with this channel, set up for
 the next on

        MOV     A,R0                    ; Get the channel command reg write addr
ess
        ADD     A,#REG_OFFSET           ; Point to the next channel
        MOV     R0,A                    ; Save it

        MOV     A,R1                    ; Get the channel command reg read addre
ss
        ADD     A,#REG_OFFSET           ; Point to the next channel
        MOV     R1,A                    ; Save it

        INC     R7                      ; Increment the channel number
        MOV     A,R7
        XRL     A,#08
        JZ      70$                     ; Finished the last channel, end
        LJMP    10$                     ; Not at the end, do the next channel

100$:   LJMP    DC_REG_TEST
70$:    LOOPCHK DC_REG_TEST              ; If man. mode and an error was hit, lo
op


        SUBTTL  INTR_TEST


        PAGE
;;;
```

```
;                       Register 3 is used to count the current channel.
;
;       INPUT:  NONE
;
;       OUTPUT: ERROR CODE
;
;;;
```

```
DC_START:
        MOV     A,#DC349_ERROR          ; TEST IDENTIFIER
        ADD     A,R7                    ; Plus the channel under test
        MOV     DPTR,#DIAG_REG          ; Send the number to the LED's
        MOVX    @DPTR,A

        MOV     R3,#ZERO                ; Clear the done with channel indicator
        MOV     DPTR,#BASE_CMD_R
        LCALL   CHANAD
        MOVX    A,@DPTR                 ; Read cmd reg to reset the Mode reg ptr
.
        MOV     DPTR,#BASE_MODE_W
        LCALL   CHANAD
        MOV     A,#05CH
        MOVX    @DPTR,A                 ; Set for 1 stop bit, odd parity,8 data
bits
        MOV     A,#0FFH
        MOVX    @DPTR,A                 ; Set for 19.2K Tx/Rx
        MOV     A,#0A5H                 ; Local Loop,enable Tx/Rx, enable Rx int
s
        CALL    WRITE_COMMAND           ; Send it to the command reg

LOOP_BACK:
        MOV     BNK1R1,#LOW TABLE-1
        MOV     R0,#LOW TABLE
        MOV     R2,#END_TABLE
LOOP:   MOV     DPTR,#BASE_STATUS
        LCALL   CHANAD

        MOV     R6,#FILL                ; Time out for ~1.5 mSec
WAIT:
        MOVX    A,@DPTR                 ; Read the status register
        JB      ACC.0,5$                ; And check to see if the transmitter is
 ready
        DJNZ    R6,WAIT                 ; Not ready yet, keep looking till the t
ime out
        ERROR   DC_START                ; Time out, transmitter never became rea
dy


5$:     CLR     A                       ; Transmitter is ready,
        MOV     DPH,#0
        MOV     DPL,R0
        MOVC    A,@A+DPTR               ; Get the byte to be sent
        MOV     DPTR,#BASE_TX
        LCALL   CHANAD                  ; Get the address for this channel, to s
end the byte
        MOVX    @DPTR,A                 ; Send the byte
        INC     R0                      ; Point to the next byte to send
        DJNZ    R2,LOOP                 ; Go send it if not at the end of the ta
ble
                                        ; Finished the table - see if we got eve
rything OK
        MOV     R6,#FILL                ; Count for ~1.5 mSec
10$:    MOV     A,R3                    ; Get the flag register(flag is set in t
he Rx intr.
        XRL     A,#0AAH                 ; Was the flag set?
        JZ      20$                     ; Yes, see if we should loop some more
        DJNZ    R6,10$                  ; Not yet, loop here till a time out
        ERROR   DC_START                ; Time out error, loop if in Man. mode


20$:    LOOPCHK DC_START                ; Re-do the same channel if error and ma
n. mode
                                        ; No, exit
        JNB     ERROR_FLAG,30$          ; Not in Man Mode - Error? No, continue
on the next
        LJMP    INIT                    ; Yes, go to init

100$:   LJMP    DC_START        ; Man. mode - was an intermittant error found? y
es -
1000$:  LJMP    DC_START ; If not done, go to DC_START

30$:    INC     R7                      ; Set up for next Channel **
        CJNE    R7,#HOST_PORT+1,1000$
```

```
; Last channel was done, do the external test if in manufacturing mode

        JNB     MAN_MODE,EX_DC349_T     ; External test if in Manufacturing mode
        CLR     DIAG_TEST               ; Indicate, done w/ uart diags
        MOV     DPTR,#DIAG_REG          ; Address of the diagnostic register
        MOV     A,#ZERO
        MOVX    @DPTR,A                 ; Clear out the led's at the end of a go
od power-up

        LJMP    INIT                    ; Else jump to initialize for operationa
l mode


        subttl  EX_DC349_T


        PAGE
;;;
```

```
        DJNZ    R2,EX_LOOP                      ; Decrement the count for the nu
mber of byte

        MOV     R6,#FILL                        ; Time out of 1.5msec
10$:    MOV     A,R3                            ; Get the end of channel indicat
or
        XRL     A,#0AAH                         ; Compare R3 to the end of chann
el flag
        JZ      20$                             ; Finished the channel
        DJNZ    R6,10$                          ; Not done yet
        SETB    ERROR_FLAG                      ; Time out error
        CLR     PASS_FAIL                       ; Indicate a failure occured
        SJMP    EX_DC_START                     ; Loop on this channel

20$:    JB      ERROR_FLAG,EX_DC_START          ; Loop on this channel on error
        INC     R7                              ; Set up for next Channel **
        CJNE    R7,#HOST_PORT+1,EX_DC_START     ; Continue with next channel if
not done

; Fall into the next test
; Last channel was done, go test the device present bits

        SUBTTL  DEV_PRSNT_TEST

        PAGE
;;;
```

```
60$:    LOOPCHK 10$                     ; If there was an intermittent, stay on
this channel
        INC     R7                      ; Next channel to check
        CJNE    R7,#HOST_PORT+1,5$      ; If this is not past the last channel t
hen go test
                                        ; Otherwise, exit

END_DEV_TST:
        SETB    PASS_FAIL                       ; Finished all tests, set the pa
ss indicator
        MOV     R6,#FILL                        ; Time out value
1$:     NOP                     ; Filler
        DJNZ    R6,1$                   ; Time out before starting test again

        LJMP    PDIAGT                  ; Last line tested, jump to the start of
 diagnostics

;       END


        SUBTTL  EQUATES

;*******************************************************************************
;
;       File: EQUATES
;
;       Description:  This file contains the constants used in the PR Box
;                     diagnostics and  firmware.
;
;*******************************************************************************

; The following values are used for access to the DC349 Octart.  Line 0 is used
; as a base address to access all of the other lines.  The offset between two
; adjacent lines registers is 8.

IO_PAGE         EQU     0E0H            ; Upper address of the i/o page
BASE_TX         EQU     0E000H          ; Address of line 0's transmitter holdin
g register(write only)
BASE_RX         EQU     0E080H          ; Address of line 0's receiver buffer re
gister(read only)
BASE_STATUS     EQU     0E081H          ; Address of line 0's status register (r
ead only)
BASE_MODE_R     EQU     0E082H          ; Address of line 0's mode 1,2 reg.(read
 address)
BASE_MODE_W     EQU     0E002H          ; Address of line 0's mode 1,2 reg.(writ
e address)
BASE_CMD_R      EQU     0E083H          ; Address of line 0's command reg. (writ
e addr)
BASE_CMD_W      EQU     0E003H          ; Address of line 0's command reg. (read
 addr)

REG_OFFSET      EQU     00008H          ; The line # is multiplied by this and a
dded
                                        ; to the base register, to get at the re
gister
                                        ; for the appropriate line.

INT_SUM_REG     EQU     0E0BCH          ; Interrupt summary Register (RO)
DATA_SUM_REG_R  EQU     0E0BDH          ; Read addr. of the data set change summ
ary reg.
DATA_SUM_REG_W  EQU     0E03DH          ; Write addr. of the data set change sum
mary reg.

; The following values are hardware reference points

BOT_ROM         EQU     0000H
TOP_ROM         EQU     1FFFH
LAST_ROM        EQU     1F00H           ; Last 256 byte block in ROM
BOT_RAM         EQU     02000H
TOP_RAM         EQU     05FFFH
LAST_RAM        EQU     05F00H          ; Last 256 byte block in external ram
PAST_RAM        EQU     HIGH BOT_RAM-01H ; 1 byte below the upper byte of bot_ra
m
```

```
BOT_IRAM        EQU     3               ; Bottom of internal ram +3
TOP_IRAM        EQU     7FH             ; Top of internal RAM

; Definitions for the diagnostic and mode registers

DIAG_REG        EQU     0E800H          ; Diagnostic LED register(R/W)
FUNCT_REG       EQU     0F000h          ; Function LED register (R/W)

YELLOW  EQU     2                       ; Function register colors
GREEN   EQU     1
RED     EQU     0

; Definitions for the error codes written to the led's

I_8031_ERROR    EQU     081H            ; Error encountered in the 8031
DIAG_REG_ERROR  EQU     082H            ; Error in the diagnostic register
FUNCT_REG_ERR   EQU     083H            ; Error in the function register
XRAM_ERROR      EQU     084H            ; Error in the external RAM
ROM_ERROR       EQU     085H            ; Error in the checksum of the ROM
UNSOL_INTR      EQU     086H            ; Received an unsolicited interrupt
DC_INT_ERR      EQU     088H            ; Error generating or receiving an inter
rupt (88 thru 8F hex)
DC_REG_ERR      EQU     090H            ; Error in the DC349 registers (codes 90
H to 97H indicate channel number)
DC349_ERROR     EQU     098H            ; Error in the local loopback of the dc3
49 (98 thru 9F hex)
DC_X_ERROR      EQU     0A0H            ; Error in the external loopback for the
 dc349 (A0 thru A7 hex)
DEV_PRSNT_ERR   EQU     0A8H            ; Base error in the device present hardw
are (CHANNELS 1,2,3,4,6 ARE TESTED)
                                        ; Error codes actually used are 0A9H,0AA
H,0ABH,0ACH,0AEH

HOST_GONE       EQU     040H            ; Reported in operational mode if the ho
st did not
                                        ; ACK/NACK a packet in the appropriate t
imer

; Error codes for the system error packet
BAD_CMD_ERR     EQU     01H             ; Bad command error code
QUE_OVERFLOW_ERR EQU    02H             ; Queue overflow error

; Test paterns  and useful equates

ZERO    EQU     00                      ; Used to clear a location
TP_1    EQU     55H                     ; Test pattern to test even bits
TP_2    EQU     0AAH                    ; Test pattern to test odd bits
FILL    EQU     0FFH                    ; Fill all locations with ones
ONE     EQU     01                      ; Used to start a walking ones pattern

TIME_COUNT      EQU     0FA9BH          ; Value loaded into timer 0 to int. ever
y 1.38mSec
T1_COUNT        EQU     0159FH          ; Value loaded into timer 1, to interrup
t every 60 mSec

KA_COUNT        EQU     0A6H            ; Value counted down in timer 1, when 0,
 send the keep alive
                                        ; NOTE: 60 mSec times 0A6H (166d) is app
rox. 10 seconds
ACK_NACK_COUNT  EQU     0FH             ; Value counted down while waiting for a
n ack or a nack (Timer 0)
                                        ; NOTE: 1.38mSec times 0FH is approx. 20
 mSec.
TEN_MS          EQU     08H             ; Value for 10mSec counted in timer0 (8*
1.38mS=~11mS).
PORT_OFF        EQU     TEN_MS          ; Value counted down for the time to wai
t before
                                        ; turning on a port again

T0_MODE1        EQU     BIT0            ; Timer 0 Mode 1
T1_MODE1        EQU     BIT4            ; Timer 1 mode 1

STACK   EQU     40H

KA      EQU     27H                     ; Pattern for a keep alive
```

```
BD_CMD   EQU     9FH                    ; Pattern for a bad command response
ACK      EQU     06H                    ; Acknowledge byte
NACK     EQU     15H                    ; Not acknowledged -(retransmit)
SOH      EQU     01H                    ; 1st byte expected on a new packet
MAX_DATA_PACK    EQU     06H            ; Max. amount of data bytes allowed in a
 packet
MAX_NACK         EQU     02H            ; Max. number of times we'll accept a
                                        ; NACK before trashing the msg.
REV_LEVEL        EQU     01H            ; Firmware revision for first release

; Bit definitions
BIT0     EQU     1H
BIT1     EQU     2H
BIT2     EQU     4H
BIT3     EQU     8H
BIT4     EQU     10H
BIT5     EQU     20H
BIT6     EQU     40H
BIT7     EQU     80H

TXIE_BIT EQU     BIT1                   ; Transmitter enable bit in the DC349 co
mmand register

ONE_STOP_BIT     EQU     BIT6           ; One stop bit, for mode register
EVEN_PARITY      EQU     BIT5+BIT4      ; Even parity, for mode register
ODD_PARITY       EQU     BIT4           ; Odd parity, for the mode register
NO_PARITY        EQU     ZERO           ; No parity, for the mode register

RERR_BIT EQU     BIT4                   ; Reset error bit in the command registe
r of the DC349
NORMAL_MODE      EQU     25H            ; To enable the command register into no
rmal
                                        ; mode, RxEN, Rx INT EN, TxEN

HDR_ERROR_BIT    EQU     BIT3           ; Error bit in the header byte sent to/r
eceived from the host
HDR_RPLY_BIT     EQU     BIT4           ; Reply bit in the header byte sent to/r
eceived from the host
HDR_KA_BIT       EQU     BIT5           ; Keep alive bit in the header byte
HDR_DC_BIT       EQU     BIT6           ; Device change bit in the header byte
HDR_SYS_ERR      EQU     BIT7           ; System error bit set in the header byt
e

BUFFER_LEN       EQU     04H            ; Number of pages in a channels buffer

BANK_3   EQU     18H                    ; Used to set the PSW to register bank #
3
BANK_2   EQU     10H                    ; Used to set the PSW to register bank #
2
BANK_1   EQU     08H                    ; Used to set the PSW to register bank #
2

DIAGS_MERGED     EQU     1              ; Set to 1 when diags are merged
                                        ; Zero when they are not
REG00    EQU     0                      ; Direct address for register 0 bank 0

BNK3R7   DATA    1FH                    ; Direct access for R7 in bank 3
BNK3R3   DATA    1BH                    ; Direct access for R3 in bank 3
BNK2R7   DATA    17H                    ; Direct access for R7 in bank 2
BNK1R1   DATA    09H                    ; Direct access for R1 in bank 1
BNK0R1   DATA    01H                    ; Direct access for R1 in bank 0
BNK0R3   DATA    03H                    ; Direct access for R3 in bank 0
BNK0R7   DATA    07H                    ; Direct access for R7 in bank 0

CHKSUM_ADDR      EQU     TOP_ROM        ; The checksum is placed in the last loc
ation of ROM
HOST_PORT        EQU     7              ; Channel for the host port
SPARE_PORT       EQU     5              ; Channel for the spare port
CMD_PORT         EQU     8              ; Logical channel for commands sent to t
he PR Box
NUM_PORTS        EQU     8              ; Number of ports
NEXT_PTR         EQU     2              ; Nuber to add to point to the next buff
er address in a queue

; Data memory
COUNT    DATA    23                     ; Used in the timer interrupt routine
```

```
; COPYRIGHT (C) 1986
; DIGITAL EQUIPMENT CORPORATION, MAYNARD, MASSACHUSETTS 01754
;
; THIS SOFTWARE IS FURNISHED  UNDER A LICENSE FOR USE ONLY ON A SINGLE
; COMPUTER  SYSTEM AND  MAY BE  COPIED ONLY WITH  THE INCLUSION OF THE
; ABOVE COPYRIGHT NOTICE.  THIS SOFTWARE, OR ANY OTHER COPIES THEREOF,
; MAY NOT BE PROVIDED OR  OTHERWISE MADE AVAILABLE TO ANY OTHER PERSON
; EXCEPT FOR USE ON SUCH SYSTEM AND TO ONE WHO AGREES TO THESE LICENSE
; TERMS.  TITLE TO AND  OWNERSHIP OF THE  SOFTWARE  SHALL AT ALL TIMES
; REMAIN IN DEC.
;
; THE INFORMATION IN THIS SOFTWARE IS SUBJECT TO CHANGE WITHOUT NOTICE
; AND SHOULD  NOT BE CONSTRUED  AS A COMMITMENT  BY DIGITAL  EQUIPMENT
; CORPORATION.
;
; DEC ASSUMES  NO  RESPONSIBILITY  FOR  THE USE OR  RELIABILITY OF ITS
; SOFTWARE ON EQUIPMENT WHICH IS NOT SUPPLIED BY DEC.


        TITLE   INIT
;;;
```

```
        MOV     DPTR,#DIAG_REG          ; Addr. of the diagnostic register
        MOVX    A,@DPTR                 ; Read the current error code
        CJNE    A,#ZERO,5$              ; If it is not zero, do not change it
        MOV     A,ERCODE                ; Otherwise, get any other possible erro
r
        MOVX    @DPTR,A                 ; Send it to the LED's
        MOV     ERCODE,#ZERO            ; And clear out the location

5$:     MOV     DPTR,#FUNCT_REG         ; Address of the function register
        MOV     A,#GREEN                ; Turn the LED green for operational mod
e
        MOVX    @DPTR,A

        MOV     R0,#REAR_RX_QUE_PTR     ; Initialize all the que pointers
        MOV     R3,#QUE_PTR_LENGTH      ; NUMBER OF LOCATIONS
10$:    MOV     @R0,#0FEH               ; All the pointers start at the end of t
he queue
        INC     R0                      ; Point to the next location
        DJNZ    R3,10$                  ; Continue initialising if not done

        MOV     R7,#10H                 ; Clear out initialize the receive and t
ransmit buff
        MOV     DPTR,#RX_BUFFERS        ; Starting addresses for each channel
        MOV     A,#ZERO
20$:    MOVX    @DPTR,A
        INC     DPTR
        DJNZ    R7,20$

        MOV     DPTR,#RX_BUFFERS+1      ; Set up to load in the upper addresses
        MOV     A,#HIGH CH0_BUFFER
        MOVX    @DPTR,A                 ; Store the buffer addr for channel 0
        MOV     A,#HIGH CH1_BUFFER
        CALL    BUF_INIT                ; Store the addr for channel 1
        MOV     A,#HIGH CH2_BUFFER
        CALL    BUF_INIT                ; Store the addr for channel 2
        MOV     A,#HIGH CH3_BUFFER
        CALL    BUF_INIT                ; Store the addr for channel 3
        MOV     A,#HIGH CH4_BUFFER
        CALL    BUF_INIT                ; Store the addr for channel 4
        MOV     A,#HIGH CH5_BUFFER
        CALL    BUF_INIT                ; Store the addr for channel 5
        MOV     A,#HIGH CH6_BUFFER
        CALL    BUF_INIT                ; Store the addr for channel 6
        MOV     A,#HIGH CH7_BUFFER
        CALL    BUF_INIT                ; Store the addr for channel 7


; Initialize the DC349

        MOV     P2,#IO_PAGE             ; P2 = upper address bits of the DC349
        MOV     R0,#LOW BASE_CMD_W      ; R0 = the write address of the 1st chan
nels command
        MOV     DPTR,#DC_INIT_TABLE     ; DPTR points to the init table for the
DC349
30$:    MOV     A,#ZERO
        MOVC    A,@A+DPTR               ; Get the byte to init the command regis
ter
        MOVX    @R0,A                   ; Send it to the command register
        DEC     R0                      ; Point to the Mode register
        INC     DPTR                    ; Point to the data for Mode reg 1
        MOV     A,#ZERO
        MOVC    A,@A+DPTR                       ; Get the byte
        MOVX    @R0,A                   ; Send the byte to Mode reg 1
        INC     DPTR                    ; Point to the data for Mode reg 2
        MOV     A,#ZERO
        MOVC    A,@A+DPTR                       ; Get the byte
        MOVX    @R0,A                   ; Send it (Mode 1 and 2 are at the same
address)
        MOV     A,R0
        ADD     A,#REG_OFFSET + 1       ; Point to the next channels command reg
ister
        MOV     R0,A                    ; Place it back in R0
        INC     DPTR                    ; Point to the data for the next command
 reg
        MOV     A,DPL                   ; See if we are past the end of the tabl
e
```

```
        CJNE    A,#LOW END_DC_INIT_TABLE,30$    ; If not at the end, do the next
 channel

;Reset the modem control register on the dc349
        MOV     R0,#LOW DATA_SUM_REG_R
        MOVX    A,@R0
        MOV     R0,#LOW DATA_SUM_REG_W
        MOVX    @R0,A

; Init the table for the timer values of each port with the default values
        MOV     P2,#TABLE_PAGE          ; Upper address of the table to hold the
 timer value
        MOV     R0,#LOW RX_DEF_T_O      ; Lower address of the table
        MOV     DPTR,#TIMER_INIT_TABLE  ; Address of the default init table
        MOV     R1,#NUM_PORTS           ; Number of values to load

40$:    CLR     A                       ; Clear the accumulator
        MOVC    A,@A+DPTR               ; Get a byte form the init table
        MOVX    @R0,A                   ; And store it in the RAM table
        INC     R0                      ; Point to the next location to fill
        INC     DPTR                    ; Point to the next byte to get
        DJNZ    R1,40$                  ; Continue if not done with the whole ta
ble

; Init the keep alive packet
        MOV     DPTR,#KA_PACKET         ; Init the keep alive packet to the appr
opriate valu
        MOV     A,#KA
        MOVX    @DPTR,A                 ; First byte is a keep alive
        INC     DPTR
        MOV     A,#ZERO
        MOVX    @DPTR,A                 ; Second byte is a zero for the number o
f data bytes

; Init the bad command packet
        MOV     DPTR,#BAD_CMD_PACKET    ; Init the bad command packet to the app
ropriate val
        MOV     A,#HDR_SYS_ERR+HOST_PORT
        MOVX    @DPTR,A                 ; First byte says it's from the PR BOX w
ith the syst
        INC     DPTR
        MOV     A,#1
        MOVX    @DPTR,A                 ; Second byte is a one for the number of
 data bytes
        INC     DPTR
        MOV     A,#BAD_CMD_ERR
        MOVX    @DPTR,A                 ; Third byte is the error byte

; Init the diagnostic packet
        MOV     DPTR,#DIAG_REG          ; Address of the diagnostic register
        MOVX    A,@DPTR                 ; Read it to get the error byte (if any)
        PUSH    ACC                     ; Save the byte

        MOV     DPTR,#DIAG_PACKET       ; Init the diagnostic packet to the appr
opriate valu
        MOV     A,#HOST_PORT+HDR_RPLY_BIT
        MOVX    @DPTR,A                 ; First byte says it's from the PR BOX,
with the rep
        INC     DPTR
        MOV     A,#DIAG_PAC_SIZE        ; Size of the diagnostic packet
        MOVX    @DPTR,A
        INC     DPTR
        POP     ACC                     ; Get the error byte back
        MOVX    @DPTR,A                 ; Store it in the packet
        INC     DPTR
        MOV     A,ERCODE                ; Get the secondary error byte
        MOVX    @DPTR,A                 ; Store it in the packet
        INC     DPTR

; Now find out the configuration of the system
        MOV     P2,#IO_PAGE             ; Upper address of the DC349
        MOV     R0,#LOW BASE_STATUS     ; Base address of the status register
        MOV     R1,#HOST_PORT+1         ; Number of channels to check
        MOV     R7,#ZERO                ; First channel
50$:    MOVX    A,@R0                   ; Read the status register
        JB      ACC.6,60$               ; No device in this port
```

```
        CALL    SET_BIT                 ; Device present, set the bit for this c
hannel
        ORL     CONFIG_BYTE,A           ; And save it in the config byte
60$:    INC     R7                      ; Next channel to check
        MOV     A,R0                    ; Get the addr. of the status register
        ADD     A,#REG_OFFSET           ; Point to the next status reg
        MOV     R0,A                    ; Place the pointer back
        DJNZ    R1,50$                  ; Loop if we are not at the end
        ANL     CONFIG_BYTE,#05EH       ; Make sure ports 0,5,and 7 are zero. Th
ey do not ha
                                        ; and the inputs are floating.
        MOV     A,CONFIG_BYTE
        MOVX    @DPTR,A                 ; Store the config byte in the diagnosti
c report

        INC     DPTR                    ; Point to the location to report the fi
rmware rev.
        MOV     A,#REV_LEVEL            ; Get the rev level
        MOVX    @DPTR,A                 ; Store the rev level

        SETB    SYS_STARTUP             ; Indicate that this is still system sta
rtup
        MOV     A,#HOST_PORT            ; Send the packet out the host port
        MOV     R7,A
        MOV     DPTR,#DIAG_PACKET       ; Beginning addr. of the packet
        CLR     PUSH_RX_TX              ; Place on Tx queue
        CALL    PUSH_MSG                ; Place the packet in the host port queu
e
        CALL    ENABLE_TX               ; Enable the transmission of the self te
st report

; Init the change in device present packet
        MOV     DPTR,#DEV_CHNG_PACKET   ; Addr. of the cange in device present p
acket
        MOV     A,#HOST_PORT+HDR_DC_BIT ; Packet header
        MOVX    @DPTR,A                 ; Place the header in the packet
        INC     DPTR                    ; Point to the size byte
        MOV     A,#1                    ; One byte to send
        MOVX    @DPTR,A                 ; Store the size byte in the packet
        INC     DPTR                    ; Packet location for the config byte
        MOV     A,CONFIG_BYTE
        MOVX    @DPTR,A                 ; Store the config byte

; Init the timers and start them
        MOV     TL0,#LOW TIME_COUNT     ; Lower 8 bits of the timer 0 value
        MOV     TH0,#HIGH TIME_COUNT    ; Upper 8 bits of the timer 0 value

        MOV     TL1,#LOW T1_COUNT       ; Lower 8 bits of the timer 1 value
        MOV     TH1,#HIGH T1_COUNT      ; Upper 8 bits of the timer 1 value

;       MOV     TMOD,#T0_MODE1 OR T1_MODE1      ; Set up the timers  for mode 0
        MOV     TCON,#ZERO              ; Turn off timers and make ints level tr
iggered

        MOV     IE,#8BH                 ; Enable interrupts (ext. int. 0 and tim
ers 0 and 1)
        MOV     IP,#0BH                 ; Set the priority for int 0 and timers
0;1 to the h
        SETB    TR0                     ; Start running timer 0
        SETB    TR1                     ; Start running timer 1

70$:    JB      SYS_STARTUP,70$         ; Wait for the ACK/NACK or time out from
 the self te

        LJMP    BACKGROUND_LOOP         ; Then go operational

        SUBTTL  BUF_INIT

        PAGE

;;;
```

```
;
;       INPUT: DTPR- Addr.-2
;              A- value to be stored
;
;       OUTPUT: (DPTR)=A
;
;;;
```

```
        SUBTTL  SAVE_REGS
        PAGE
;;;
```

```
;                       to a Tx queue (BUFFER_MOVE).  Also made the main loop
;                       so that no channels were prioritised.
;
;;;
```

```
        MOV     R1,#FRONT_TX_QUE_PTR    ; Initialize R1 to point at the front tr
ansmit que p

15$:    MOV     A,R7
        XRL     A,#HOST_PORT + 1
        JZ      50$                     ; If we're past the last channel go chec
k the comman
        MOV     A,@R1                   ; Place the current queue's front pointe
r in the acc
        XRL     A,@R0                   ; Is it equal with the rear??
        JZ      17$                     ; YES, nothing is in the queue

16$:    MOV     A,TX_IN_PROCESS         ; See if we are already transmitting on
        LCALL   TEST_BIT                ; channel
        JC      17$                     ; Yes, skip it for now

        ACALL   ENABLE_TX               ; Enable the transmitter interrupt for t
his channel

17$:    INC     R7                      ; Yes, the queue is empty, look at the n
ext one
        INC     R0                      ; Point to the next REAR pointer
        INC     R1                      ; Point to the next FRONT pointer
        CJNE    R7,#HOST_PORT,15$       ; Are we at the last channel? No, see if
 this queue

                                        ; Yes, check for various other condition
s on the hos
        JB      SEND_ACK,16$            ; For instance, enable the transmitter i
f we have to
        JB      SEND_NACK,16$           ; Or, enable the transmitter if we have
to send a NA

        JNB     SEND_KA,40$             ; If we don't have to send a Keep alive,

        MOV     A,#HOST_PORT            ; Port to send the keep alive (host)

        MOV     DPTR,#KA_PACKET         ; Keep alive packet to send
        CLR     PUSH_RX_TX              ; Push the keep alive msg on the back of
 the host
        CALL    PUSH_MSG                ; port transmit queue
        JC      40$                     ; Queue was full, try to empty it

        CLR     SEND_KA                 ; Clear the flag, it was put in the queu
e
        SJMP    16$                     ; Turn on the transmitter

40$:    JNB     WAIT_ACK_NACK,15$       ; If we don't have to wait for an ACK/NA
CK, check th

50$:    MOV     R0,#REAR_TX_QUE_PTR+CMD_PORT ; Point to the rear of the PR Box c
ommand que
        MOV     R1,#FRONT_TX_QUE_PTR+CMD_PORT ; Point to the front of the PR Box
 command que
        MOV     R7,#CMD_PORT            ; Command queue (logical channel 8)

        MOV     A,@R1                   ; Place the queue's front pointer in the
 accumulator
        XRL     A,@R0                   ; Is it equal with the rear??
        JZ      BACKGROUND_LOOP         ; Yes, que is empty, start from the begi
nning

        CALL    PARSE_COMMAND           ; No, execute the command in the buffer

        SJMP    BACKGROUND_LOOP         ; Start looking from channel zero again.

        SUBTTL  BUFFER_MOVE

        PAGE
;;;
```

```
;       DESCRIPTION:    This subroutine will move a received buffer address
;                       from a receive queue to a transmit queue.  It will
;                       do this only if the transmit queue is empty.  If the
;                       que is the host que,  the channel to transmit it to
;                       is the first byte in the buffer.  If the receive was
;                       on any other channel, it will be transmitted on the
;                       host port.
;
;       INPUT:  R7 = Rx channel number
;               R0 = Address of the REAR_RX_QUE_PTR
;               R1 = Address of the FRONT_RX_QUE_PTR
;
;       OUTPUT: -The buffer at the front of the Rx que, is moved to the rear
;               of the appropriate Tx queue.
;               -(R1) is incremented by two (The FRONT_RX_QUE_PTR for that chann
el
;               -The REAR_TX_QUE_PTR for that channel is incremented by two.
;
;;;
```

```
        SJMP    END_XFER

30$:    MOV     A,@R1                   ; Get the pointer to the front of the qu
eue
        ADD     A,#NEXT_PTR             ; Point to the first buffer address in t
he queue
        MOV     R0,A                    ; Put it in R0 to use as an external fet
ch

        MOVX    A,@R0                   ; Get the received buffer lower address
bits
        MOV     DPL,A                   ; And save it in DPL
        INC     R0                      ; Point to the high byte of the address
        MOVX    A,@R0                   ; Do the same for  the upper byte
        MOV     DPH,A                   ; And save it in DPH

        MOV     A,#HOST_PORT            ; Port number to check the Tx que
        SJMP    10$                     ; Now, make sure that the HOST PORT Tx b
uffer isnt f

20$:
        POP     ACC
        MOV     R1,A                    ; Restore R1
        POP     ACC
        MOV     R0,A                        ; Restore R0
END_XFER:
        RET

        SUBTTL  ENABLE_TX
        PAGE
;;;
```

```
;
;       OUTPUT: Carry is set if transfer was not done due to full queue
;               Tx or Rx_queue(channel) = DPTR
;
;;;
```

```
; COMPUTER  SYSTEM AND  MAY BE  COPIED ONLY WITH  THE INCLUSION OF THE
; ABOVE COPYRIGHT NOTICE.  THIS SOFTWARE, OR ANY OTHER COPIES THEREOF,
; MAY NOT BE PROVIDED OR  OTHERWISE MADE AVAILABLE TO ANY OTHER PERSON
; EXCEPT FOR USE ON SUCH SYSTEM AND TO ONE WHO AGREES TO THESE LICENSE
; TERMS.  TITLE TO AND  OWNERSHIP OF THE  SOFTWARE  SHALL AT ALL TIMES
; REMAIN IN DEC.
;
; THE INFORMATION IN THIS SOFTWARE IS SUBJECT TO CHANGE WITHOUT NOTICE
; AND SHOULD  NOT BE CONSTRUED  AS A COMMITMENT  BY DIGITAL  EQUIPMENT
; CORPORATION.
;
; DEC ASSUMES  NO  RESPONSIBILITY  FOR  THE USE OR  RELIABILITY OF ITS
; SOFTWARE ON EQUIPMENT WHICH IS NOT SUPPLIED BY DEC.
;*********************************************************************;
;*                                                                   *;
;*      MACRO definition                                             *;
;*                                                                   *;
;*********************************************************************;

ERROR   MACRO   %LOOP
        CLR     PASS_FAIL               ; Clear the pass/fail bit - to indicate
failure
        SETB    ERROR_FLAG              ; Set for the code to indicate an error
was found
                                        ; This is for interrmitant errors
        JNB     MAN_MODE,%LOOP          ; If manuf. mode bit is low (active), ju
mp to loop location

        LJMP    INIT                    ; Else go to init the operational code
        ENDM


ERRORA  MACRO   %LOOP,%CNTNUE
        CLR     PASS_FAIL               ; Clear the pass/fail bit - to indicate
failure
        SETB    ERROR_FLAG              ; Set for the code to indicate an error
was found
                                        ; This is for interrmitant errors
        JNB     MAN_MODE,%LOOP          ; If manuf. mode bit is low (active), ju
mp to loop location
        CALL    RX_ERROR                ; Call the receive error routine
        SJMP    %CNTNUE                 ; Else go to location to continue operat
ion
        ENDM


LOOPCHK MACRO   %LOOP
LCL     SET     $
        JB      MAN_MODE,LCL+6          ; If manuf. mode bit is high (not man. m
ode), continue
        JB      ERROR_FLAG,%LOOP        ; Man. mode - was an intermittant error
found? yes - loop
                                        ; No, exit
        ENDM



        SUBTTL  SAVE_REGS
        PAGE
;;;
```

```
        PUSH    PSW
        PUSH    DPL
        PUSH    DPH

        CLR     A
        jbc     P2.0,1$
        mov     A,#1
1$:     jbc     P2.1,2$
        setb    ACC.1
2$:     jbc     P2.2,3$
        setb    ACC.2
3$:     jbc     P2.3,4$
        setb    ACC.3
4$:     jbc     P2.4,5$
        setb    ACC.4
5$:     jbc     P2.5,6$
        setb    ACC.5
6$:     jbc     P2.6,7$
        setb    ACC.6
7$:     jbc     P2.7,8$
        setb    ACC.7
8$:     cpl     A
        push    ACC             ; Save P2.
        ENDM

        SUBTTL  RESTORE_REGS
        PAGE
;;;
```

```
        PUBLIC  READ_ERROR,CHANNEL_SENT,SIZE_SENT,SEND_ACK
        PUBLIC  SEND_NACK,IN_RX,WAIT_ACK_NACK,SEND_KA,NO_HOST,SYS_STARTUP
        PUBLIC  PASS_FAIL,MAN_MODE,REAR_RX_QUE_PTR,FRONT_RX_QUE_PTR
        PUBLIC  REAR_TX_QUE_PTR,FRONT_TX_QUE_PTR,SPS,BASE_RX_PAGE,RX_0_QUE
        PUBLIC  RX_7_QUE,BASE_TX_PAGE,TX_0_QUE,TX_7_QUE,TABLE_PAGE,RX_BUFFERS
        PUBLIC  TX_BUFFERS,TX_SIZE_TBL,RX_DEF_T_O,RX_TIME_OUT,KA_TIMER
        PUBLIC  ACK_NACK_TIMER,TEMP_SEND,KA_PACKET,BAD_CMD_PACKET,DIAG_PACKET
        PUBLIC  DIAG_PAC_SIZE,DEV_CHNG_PACKET,CH0_BUFFER,CH1_BUFFER,CH2_BUFFER
        PUBLIC  CH3_BUFFER,CH4_BUFFER,CH5_BUFFER,CH6_BUFFER,CH7_BUFFER
        PUBLIC  END_BUFFER_SPACE,PORT_TIME_OUT,QUE_PTR_LENGTH


;*************************************************************************;
;*                                                                       *;
;*      OS literal                                                       *;
;*                                                                       *;
;*************************************************************************;


STKSIZ  DATA    40H     ; Number of bytes reserved in stack area


;*************************************************************************;
;*                                                                       *;
;*      Internal RWM                                                     *;
;*                                                                       *;
;*************************************************************************;

        DSEG
        ORG     0000H
BANKS:  DS      20H     ; 4 register banks
FLAGGS: DS      1H

RX_IN_PROCESS:  DS      1H      ; Flags for each port recievers

TX_IN_PROCESS:  DS      1H      ; Flags for each port transmitters
RX_TX_FLAGS:    DS      1H      ; Flags for the receivers
SYS_FLAGS:      DS      1H      ; System flags
TX_CHECKSUM:    DS      1H      ; Checksum calculated for the current transmissi
on
RX_CHECKSUM:    DS      1H      ; Checksum calculated for the current reception

HOST_SIZE:      DS      1H      ; Size of the msg data being received on the hos
t channel
TX_SIZE:        DS      1H      ; Size of the msg data being transmited (local v
ariable)
ERCODE:         DS      1H      ; Error code byte for diagnostics

NACK_COUNT:     DS      1H      ; Count for the number of times a NACK is rcvd f
or a msg
CMD_SIZE:       DS      1H      ; Temp. for holding the size byte when a command
 is received
CONFIG_BYTE:    DS      1H      ; Holding location for the system configuration
CHAN:           DS      1H      ; Holding loc. for the channel in the change bau
d rate comma
;
;*************************************************************************;
;*                                                                       *;
;*      BIT FLAGS                                                        *;
;*                                                                       *;
;*************************************************************************;

FLAG_1  BIT     FLAGGS.0
DIAG_TEST BIT   FLAGGS.1        ; Set for using the diagnostic uart routine
ERROR_FLAG BIT  FLAGGS.2        ; Set when an error was found in the diagnostics
TX_INTR BIT     FLAGGS.3        ; Set in the diagnostic transmitter interrupt ro
utine


RX_0    BIT     RX_IN_PROCESS.0 ; Receiving on channel 0
RX_1    BIT     RX_IN_PROCESS.1 ; Receiving on channel 1
```

```
RX_2     BIT     RX_IN_PROCESS.2 ; Receiving on channel 2
RX_3     BIT     RX_IN_PROCESS.3 ; Receiving on channel 3
RX_4     BIT     RX_IN_PROCESS.4 ; Receiving on channel 4
RX_5     BIT     RX_IN_PROCESS.5 ; Receiving on channel 5
RX_6     BIT     RX_IN_PROCESS.6 ; Receiving on channel 6
RX_7     BIT     RX_IN_PROCESS.7 ; Receiving on channel 7

TX_0     BIT     TX_IN_PROCESS.0 ; Transmitting on channel 0
TX_1     BIT     TX_IN_PROCESS.1 ; Transmitting on channel 1
TX_2     BIT     TX_IN_PROCESS.2 ; Transmitting on channel 2
TX_3     BIT     TX_IN_PROCESS.3 ; Transmitting on channel 3
TX_4     BIT     TX_IN_PROCESS.4 ; Transmitting on channel 4
TX_5     BIT     TX_IN_PROCESS.5 ; Transmitting on channel 5
TX_6     BIT     TX_IN_PROCESS.6 ; Transmitting on channel 6
TX_7     BIT     TX_IN_PROCESS.7 ; Transmitting on channel 7

CHANNEL_RCVD     BIT     RX_TX_FLAGS.0   ; Channel number received flag
SIZE_RCVD        BIT     RX_TX_FLAGS.1   ; Size of the msg data received flag
READ_ERROR       BIT     RX_TX_FLAGS.2   ; Flag set when there was an error readi
ng the chara
CHANNEL_SENT     BIT     RX_TX_FLAGS.3   ; Channel sent flag for host transmit ro
utine
SIZE_SENT        BIT     RX_TX_FLAGS.4   ; Size sent flag for host transmit routi
ne
PUSH_RX_TX       BIT     RX_TX_FLAGS.5   ; If PUSH_RX_TX=1 then push the msg on t
he rear of t

SEND_ACK         BIT     SYS_FLAGS.0     ; Flag to send an ACK
SEND_NACK        BIT     SYS_FLAGS.1     ; Flag to send a NACK
IN_RX            BIT     SYS_FLAGS.2     ; Flag set while in the receiver interru
pt
WAIT_ACK_NACK    BIT     SYS_FLAGS.3     ; Flag to indicate we are waiting for an
 ACK/NACK fr
SEND_KA          BIT     SYS_FLAGS.4     ; Flag set to send a keep alive.
NO_HOST          BIT     SYS_FLAGS.5     ; Flag set when the host does not ACK/NA
CK a packet
SYS_STARTUP      BIT     SYS_FLAGS.6     ; Flag set to indicate we are just start
ing up

PASS_FAIL        BIT     P1.6            ; Status reporting flag (0 = diagnostics
 failed)
MAN_MODE         BIT     P1.7            ; Bit to see what mode we are in (0 = Ma
nufacturing)


; NOTE: The extra pointer for the rear and front of the queues are for the
;       commands directed to the PR Box itself, and the msgs. from the PR Box

REAR_RX_QUE_PTR: DS      9       ; Table of ptrs to the rear of each channels rec
eiver queue
FRONT_RX_QUE_PTR: DS     9       ; Table of ptrs to the front of each channels re
ceiver queue

REAR_TX_QUE_PTR: DS      9       ; Table of ptrs to the rear of each channels tra
nsmitter que
FRONT_TX_QUE_PTR: DS     9       ; Table of ptrs to the front of each channels tr
ansmitter qu
QUE_PTR_LENGTH   EQU     $-REAR_RX_QUE_PTR  ; Number of que pointer locations
SPS      EQU     $               ; Stack area

;*********************************************************************;
;*                                                                   *;
;*      External RWM                                                 *;
;*                                                                   *;
;*********************************************************************;

         XSEG
         ORG     2000H

BASE_RX_PAGE     XDATA   HIGH $  ; Base page for the receiver queues
RX_0_QUE:        DS      100H    ; Receiver queue for channel 0
RX_1_QUE:        DS      100H    ; Receiver queue for channel 1
```

```
RX_2_QUE:        DS      100H    ; Receiver queue for channel 2
RX_3_QUE:        DS      100H    ; Receiver queue for channel 3
RX_4_QUE:        DS      100H    ; Receiver queue for channel 4
RX_5_QUE:        DS      100H    ; Receiver queue for channel 5
RX_6_QUE:        DS      100H    ; Receiver queue for channel 6
RX_7_QUE:        DS      100H    ; Receiver queue for channel 7
RX_CMD_QUE:      DS      100H    ; Msgs. to be sent out on the host port
                                 ; are first placed here in case the host Tx que
                                 ; is full

BASE_TX_PAGE     XDATA   HIGH $  ; Base page for the transmitter queues
TX_0_QUE:        DS      100H    ; Transmitter queue for channel 0
TX_1_QUE:        DS      100H    ; Transmitter queue for channel 1
TX_2_QUE:        DS      100H    ; Transmitter queue for channel 2
TX_3_QUE:        DS      100H    ; Transmitter queue for channel 3
TX_4_QUE:        DS      100H    ; Transmitter queue for channel 4
TX_5_QUE:        DS      100H    ; Transmitter queue for channel 5
TX_6_QUE:        DS      100H    ; Transmitter queue for channel 6
TX_7_QUE:        DS      100H    ; Transmitter queue for channel 7
TX_CMD_QUE:      DS      100H    ; Que for commands to the PR Box


;        ORG     3200H           ; Begining of the buffer space
CH0_BUFFER:      DS      300H    ; Reserve 3/4K for channel 0
CH1_BUFFER:      DS      800H    ; Reserve 2K for channel 1
CH2_BUFFER:      DS      800H    ; Reserve 2K for channel 2
CH3_BUFFER:      DS      600H    ; Reserve 1.5K for channel 3
CH4_BUFFER:      DS      300H    ; Reserve 3/4K for channel 4
CH5_BUFFER:      DS      300H    ; Reserve 3/4K for channel 5
CH6_BUFFER:      DS      300H    ; Reserve 3/4K for channel 6
CH7_BUFFER:      DS      0B00H   ; Reserve 2.75K for channel 7


END_BUFFER_SPACE XDATA   HIGH $  ; End of the buffer space

         ORG     5F00H           ; TABLE PAGE
TABLE_PAGE       XDATA   HIGH $  ; Base page for various tables
RX_BUFFERS:      DS      10H     ; Pointers for each channel to the next free byt
e in the rec
TX_BUFFERS:      DS      10H     ; Pointers for each channel to the next byte to
send in the
TX_SIZE_TBL:     DS      08H     ; Number of bytes left to send (transmit)
RX_DEF_T_O:      DS      08H     ; Default timer values for each receiver port
RX_TIME_OUT:     DS      08H     ; Timer bytes for received character (decremente
d in the tim
PORT_TIME_OUT:   DS      08H     ; Timers used to cound down when a port is turne
d off.
KA_TIMER:        DS      01H     ; Timer kept for sending Keep Alive messages
ACK_NACK_TIMER:  DS      01H     ; Timer kept for maximum time to wait for an ACK
 or a NACK
TEMP_SEND:       DS      01H     ; Temporary loc used to send ACK, NACK, SOH
KA_PACKET:       DS      02H     ; Keep alive message packet
BAD_CMD_PACKET:  DS      03H     ; Bad command response packet
DIAG_PACKET:     DS      06H     ; Diagnostic report message
DIAG_PAC_SIZE    EQU     $-DIAG_PACKET-2 ; Number of report bytes in the packet(t
he -2 is for
DEV_CHNG_PACKET: DS      03      ; Device change report message


         END
         title PR BOX SUBROUTINES


;;;
```

```
;-------------------------  BL2  ----------------------------------------
;                9/11/86 Changed the subroutine name GET_BUF to INC_BUF.
;                        The old name was a misnomer.
;
;;;
```

```
        AJMP    21$                     ; test till all 8 are over
25$:
        POP     ACC                     ; load bit number from earlier store
        RET
30$:
        CLR     A
        RET


        SUBTTL  MOVE_A

        PAGE

;*****************************************************************
;                                                                *
;                        MOVE_A                                  *
;                                                                *
;  THIS IS ROUTINE USED BY THE TIMER TEST MODULE WHICH MIGRATES  *
;  A DATA PATTERN THRU THE TIMER(0,1) REGISTERS.                 *
;                                                                *
; PARAMETERS:  A        - DATA PATTERN                          *
;                                                                *
;*****************************************************************

MOVE_A:         MOV     TL0,A                   ;PATTERN TO TL0.
                MOV     A,TL0                   ;VERIFY.
                MOV     TH0,A                   ;SAME TO TH0.
                MOV     A,TH0                   ;VERIFY.
                MOV     TL1,A                   ;SAME TO TL1.
                MOV     A,TL1                   ;VERIFY.
                MOV     TH1,A                   ;SAME TO TH1.
                MOV     A,TH1                   ;VERIFY.

                RET                             ;RETURN.

        SUBTTL  CHANAD


        PAGE
;;;
```

```
;       DESCRIPTION:    This subroutine will take the number in R7, multiply it
;                       by eight and add it to REGISTER 1.  This
;                       routine is used for getting the appropriate address
;                       for the current port on the octart.
;
;       INPUT:  Channel number in R7
;               Base register address in R1
;
;       OUTPUT: Direct register address in R1
;;;
```

```
40$:    CJNE    A,#HIGH CH5_BUFFER,50$  ; Beginning of channel 5's buffer?
        MOV     DPH,#HIGH CH4_BUFFER    ; Yes, reset the buffer to the beginning
 of channel
        SJMP    80$

50$:    CJNE    A,#HIGH CH6_BUFFER,60$  ; Beginning of channel 6's buffer?
        MOV     DPH,#HIGH CH5_BUFFER    ; Yes, reset the buffer to the beginning
 of channel
        SJMP    80$

60$:    CJNE    A,#HIGH CH7_BUFFER,70$  ; Beginning of channel 7's buffer?
        MOV     DPH,#HIGH CH6_BUFFER    ; Yes, reset the buffer to the beginning
 of channel
        SJMP    80$
70$:    CJNE    A,#END_BUFFER_SPACE,80$ ; Are we at the end of the buffer space?
        MOV     DPH,#HIGH CH7_BUFFER    ; Yes, reset the buffer to the beginning
 of channel

80$:    POP     ACC                     ; Else return
        RET

        SUBTTL  TEST_BIT

        PAGE

;;;
```

```
;               ORL     RX_IN_PROCESS,A ; SET THAT FLAG IN THE APPROPRIATE BYTE
;;;
```

```
        POP     DPH
        POP     DPL             ; Restore the data pointer
        RET

        SUBTTL  READ_COMMAND


        PAGE
;;;
```

```
TIMER0_INT:
        SAVE_REGS          ; Save the background picture

        MOV     PSW,#BANK_1       ; Switch to register bank 1

        MOV     TH0,#HIGH TIME_COUNT     ; Reload the timer value

        MOV     TL0,#LOW TIME_COUNT

        MOV     DPTR,#RX_TIME_OUT ; Address of the timer bytes for each channel
        MOV     R0,#7             ; Number of channels to check
        MOV     R7,#ZERO          ; First channel to be tested

10$:    MOVX    A,@DPTR           ; Get the current channels timer
        XRL     A,#ZERO           ; Is this channels timer zero? (ie. inactive)
        JZ      20$               ; Yes, point to the next channel

        DEC     A                 ; Counter was not zero, decrement it by one
        MOVX    @DPTR,A           ; Save it back in the counters timer
        CJNE    A,#ZERO,20$       ; If it still isn't zero then  go on to the next
 channel
        CALL    END_MSG           ; Otherwise, close out the buffer and check out
the next cha

20$:    INC     DPTR              ; Look at the next channel
        INC     R7                ; increment the channel number
        DJNZ    R0,10$            ; Look at the next timer byte if not done with a
11 the chann
                                  ; Finished with all the peripheral channels

        JNB     RX_7,25$          ; If not currently receiving on the host port, c
ontinue else
        MOVX    A,@DPTR           ; Otherwise check the timer for a time out
        DEC     A                 ; If we are here, the timer is active, decrement
 the count
        MOVX    @DPTR,A           ; Stoer it back
        CJNE    A,#ZERO,25$       ; No time out, continue elsewhere
        SETB    SEND_NACK         ; Time out, send a NACK
        CLR     RX_7              ; Clear in receiver on host flag
        CLR     CHANNEL_RCVD      ; Clear channel received flag
        CLR     SIZE_RCVD         ; Clear size received flag

; Now check for a time out to turn on a channel that was turned off

25$:    MOV     DPTR,#PORT_TIME_OUT      ; Addr. of the timers for the ports
        MOV     R0,#NUM_PORTS            ; Check all the ports
        MOV     R7,#ZERO                 ; Start with channel zero

30$:    MOVX    A,@DPTR           ; Get the current channels timer
        XRL     A,#ZERO           ; Is this channels timer zero? (ie. inactive)
        JZ      40$               ; Yes, point to the next channel

        DEC     A                 ; Counter was not zero, decrement it by one
        MOVX    @DPTR,A           ; Save it back in the counters timer
        CJNE    A,#ZERO,40$       ; If it still isn't zero then  go on to the next
 channel
        CALL    READ_COMMAND      ; Read the command register to
        ORL     A,#BIT2           ; Set up to enable the receiver again
        CALL    WRITE_COMMAND     ; Write it out to the port

40$:    INC     DPTR              ; Look at the next channel
        INC     R7                ; increment the channel number
        DJNZ    R0,30$            ; Look at the next timer byte if not done with a
11 the chann
                                  ; Finished with all the channels

; Now check the timer for the time out waiting for an ACK/NACK from the host

        JNB     WAIT_ACK_NACK,50$ ; We're not waiting for an ACK/NACK, so exit
```

```
        MOV     DPTR,#ACK_NACK_TIMER ; Address of the ACK/NACK timer
        MOVX    A,@DPTR              ; Get the timer
        DEC     A                    ; Decrement the timer
        MOVX    @DPTR,A              ; Store it back
        CJNE    A,#ZERO,50$          ; It's not zero yet, so leave
        CLR     WAIT_ACK_NACK        ; It is zero, clear the wait flag
        MOV     R7,#HOST_PORT        ; Working on the host channel
        CALL    BUMP_FRONT_TX        ; Bump the front pointer of the transmit queue
        CLR     TX_7                 ; Clear the flag indicating we're transmitting o
n the host p

        JB      SYS_STARTUP,42$ ; If it was the system startup, do not place the
 error in th
        MOV     A,#HOST_GONE         ; Put the error code for no response from host
        CALL    LIGHT_LED            ; Send the error code
        SETB    NO_HOST              ; Set the flag to indicate the host went away

42$:    CLR     SYS_STARTUP          ; Clear the system startup flag

50$:    RESTORE_REGS                 ; Restore the background picture
        RETI                         ; Return from the interrupt


        SUBTTL  TIMER1_INT

        PAGE
;;;
```

```
        TITLE   UART INTERRUPT ROUTINE
;
; COPYRIGHT (C) 1986
; DIGITAL EQUIPMENT CORPORATION, MAYNARD, MASSACHUSETTS 01754
;
; THIS SOFTWARE IS FURNISHED  UNDER A LICENSE FOR USE ONLY ON A SINGLE
; COMPUTER  SYSTEM AND  MAY BE  COPIED ONLY WITH  THE INCLUSION OF THE
; ABOVE COPYRIGHT NOTICE.  THIS SOFTWARE, OR ANY OTHER COPIES THEREOF,
; MAY NOT BE PROVIDED OR  OTHERWISE MADE AVAILABLE TO ANY OTHER PERSON
; EXCEPT FOR USE ON SUCH SYSTEM AND TO ONE WHO AGREES TO THESE LICENSE
; TERMS.  TITLE TO AND  OWNERSHIP OF THE  SOFTWARE  SHALL AT ALL TIMES
; REMAIN IN DEC.
;
; THE INFORMATION IN THIS SOFTWARE IS SUBJECT TO CHANGE WITHOUT NOTICE
; AND SHOULD  NOT BE CONSTRUED  AS A COMMITMENT  BY DIGITAL  EQUIPMENT
; CORPORATION.
;
; DEC ASSUMES  NO  RESPONSIBILITY  FOR  THE USE OR  RELIABILITY OF ITS
; SOFTWARE ON EQUIPMENT WHICH IS NOT SUPPLIED BY DEC.


        RSECT   PRCODE
        INTERN  UART_SERVICE,RX_ERROR,END_MSG,BUMP_FRONT_TX,DE_QUE_TX


        EXTERN  CHANADR1,CHANAD,INC_BUF,CLEAR_BIT,SET_BIT,TEST_BIT
        EXTERN  LIGHT_LED,PUSH_MSG,WRITE_COMMAND,READ_COMMAND

        SUBTTL  UART_SERVICE

        include macro.src

        PAGE
;;;
```

```
        MOV     DPTR,#INT_SUM_REG
        MOVX    A,@DPTR                 ; Read the interrupt summary register
        RRC     A                       ; Shift the lower bit out into the carry
 flag
        ANL     A,#0FH                  ; Mask out everything except for the por
t #
        MOV     R7,A                    ; Save the channel number in R7
        RL      A                       ; Multiply it by 2 (Some pointers are 2
bytes wide)
        MOV     R6,A                    ; Save it in R6

        JNC     RX_CHAR                 ; If carry is not set, then receive a ch
aracter

        LJMP    TX_CHAR                 ; Else, transmit a character

  RX_CHAR:
        SETB    IN_RX                   ; Flag indicating in the reveiver interr
upt
        CJNE    R7,#HOST_PORT,10$       ; Was this for the host port?
        LJMP    HOST_CHAR               ; Yes, go handle it

  10$:  MOV     DPTR,#DATA_SUM_REG_R    ; Addr. of the data set change summary r
egister
        MOVX    A,@DPTR                 ; See if a device was plugged/unplugged
        ANL     A,#5EH                  ; Make sure it's only on the channels wi
th dev. pres
        JZ      40$                     ; No, it was a normal receive

        MOV     P2,#IO_PAGE             ; There was a change in a device state
        MOV     R1,#LOW BASE_STATUS     ; Lower address of the status register
        CALL    CHANADR1                ; Calc. address for this channel
        MOVX    A,@R1                   ; Read the status to determine if the de
vice is conn
        JB      ACC.6,20$               ; The device was removed, clear the conf
ig bit.

        CALL    SET_BIT                 ; Device is present, set the config bit
        ORL     CONFIG_BYTE,A
        SJMP    30$

  20$:  CALL    CLEAR_BIT               ; Device was removed
        ANL     CONFIG_BYTE,A           ; Clear the config byte

  30$:  MOV     DPTR,#DIAG_PACKET+4     ; Addr of the config byte in the diagnos
tic packet
        MOV     A,CONFIG_BYTE           ; Byte to place in the packet
        MOVX    @DPTR,A                 ; Store the byte

        MOV     DPTR,#DEV_CHNG_PACKET+2 ; Addr. of the config byte in the device
 change mess
        MOVX    @DPTR,A                 ; Store the config byte

        MOV     DPTR,#DEV_CHNG_PACKET   ; Address of the buffer to send to the h
ost
        MOV     A,#CMD_PORT             ; Store it in the Rx queue of the comman
d port
        SETB    PUSH_RX_TX              ; Place in the Rx queue
        CALL    PUSH_MSG                ; Place it in the queue

        MOV     DPTR,#DATA_SUM_REG_W    ; Write addr. of the data set change sum
mary  reg.
        CALL    SET_BIT                 ; Set the corresponding bit for the curr
ent channel
        MOVX    @DPTR,A                 ; To clear it in the data summary reg.
        LJMP    UART_RET

  40$:  MOV     A,RX_IN_PROCESS         ; Get the receiving flags for the channe
s
        LCALL   TEST_BIT                ; Are we in the middle of receiving a pa
cket?
```

```
        JC      RX_CONTINUE             ; Yes, continue with the current packet.
                                        ; No, this is the start of a new packet.

        CALL    QUE_BUFFER              ; Put the beginning address of the buffe
r
                                        ; into the rear of the queue, and in the
 DPTR
        JNC     50$                     ; Queue was not full, continue
                                        ; The queue was full, DPTR= beginning ad
dr of last m
        CALL    HANDLE_OVRFLOW          ; Turn off the receiver, set up the over
flow msg.
        SJMP    UART_RET                ; Return from the interrupt

  50$:  LCALL   SET_BIT
        ORL     RX_IN_PROCESS,A         ; Set the flag to indicate we are receiv
ing on this

        MOV     A,R7                    ; Get the port number
        MOVX    @DPTR,A                 ; And store it in the buffer as the head
er
        CALL    INC_BUF                 ; Point to the next byte in the buffer
        MOV     A,#1
        MOVX    @DPTR,A                 ; Init the size counter to 1
        CALL    INC_BUF                 ; Point to the next byte in the buffer

        CALL    READ_CHAR               ; Read the character from the DC349

        MOVX    @DPTR,A                 ; Save the byte in the buffer
        CALL    INC_BUF                 ; Point to the next buffer

  END_RX:
        CALL    SAVE_BUF                ; Save the current buffer address

        CALL    INIT_CTR                ; Init the timer value for this channel
        CJNE    R7,#SPARE_PORT,10$      ; If the channel is the spare port,
        CALL    END_MSG                 ; Then end the message buffer (spare por
t has single

  10$:  SJMP    UART_RET                ; Return

  RX_CONTINUE:
        CALL    GET_BUF                 ; Get the current buffer location
        CALL    READ_CHAR               ; Read the character
        MOVX    @DPTR,A                 ; Save the character in the buffer
        CALL    INC_BUF                 ; Point to the next free buffer location
        CALL    SAVE_BUF                ; Save the current buffer location

        CALL    FRONT_BUFFER            ; Get the address of the front of the cu
rrent buffer
        CALL    INC_BUF                 ; Increment the DTPR to point to the siz
e byte
        MOVX    A,@DPTR                 ; Read the size byte
        INC     A                       ; Increment the size byte
        MOVX    @DPTR,A                 ; Store it back in the buffer
        CJNE    A,#MAX_DATA_PACK,10$    ; If SIZE=Maximum,
        CALL    END_MSG                 ; THEN end the message buffer
        SJMP    UART_RET

  10$:  LCALL   INIT_CTR                ; ELSE init the timer variable for this
channel

  UART_RET:
        CLR     IN_RX                   ; Not in receiver int. anymore (or any i
nt for that
        RESTORE_REGS                    ; Restore P2, DPTR, PSW, and the ACC
        RETI
;       PAGE
  HOST_CHAR:
        JB      RX_7,HOST_CONTINUE      ; Already receiving a packet, continue

        JNB     NO_HOST,5$              ; If the host did not previously go away
,go read the
```

```
        CLR     NO_HOST                 ; The host is back now, indicate the hos
t is here
        MOV     A,#ZERO                 ; Clear out the no host error in the LED
s
        CALL    LIGHT_LED               ; Send it to the LEDs

  5$:   CALL    READ_CHAR               ; Read the character from the port
        JNB     READ_ERROR,10$          ; No error, continue
                                        ; ERROR
        SETB    SEND_NACK               ; Set the flag to send a nack to the hos
t
        SJMP    UART_RET                ; Return

  10$:  CJNE    A,#SOH,20$              ; Was the byte read SOH? No continue
        CALL    QUE_BUFFER              ; Get a buffer
        JNC     15$                     ; No problem
        CALL    HANDLE_OVRFLOW          ; Overflow, turn off the receiver, put i
n the que an
        SJMP    UART_RET
-----------------------------------------------------------------------------
  15$:  MOV     RX_CHECKSUM,#SOH        ; Yes, init the checksum to 1
        SETB    RX_7                    ; Set the flag for receiving on host cha
nnel
        CALL    INIT_CTR                ; Init the timer for this channel
        CALL    SAVE_BUF                ; Save the buffer address
        SJMP    UART_RET                ; Return

  20$:  CJNE    A,#ACK,30$              ; Was the byte read an ACK? No continue
        JNB     WAIT_ACK_NACK,UART_RET  ; Yes, are we waiting for an ACK? No, re
turn
        CLR     WAIT_ACK_NACK           ; Yes, clear the wait indicator
        CLR     SYS_STARTUP             ; Clear the system startup flag
        MOV     NACK_COUNT,#ZERO        ; Clear out the number of NACK's we rcvd
        CALL    BUMP_FRONT_TX           ; Remove the msg just sent from the queu
e
        CLR     TX_7                    ; Clear the flag to enable transmitting
to the host
        SJMP    UART_RET                ; Return

  30$:  CJNE    A,#NACK,40$             ; Was the byte read a NACK? No ERROR
        JB      WAIT_ACK_NACK,32$       ; Yes, are we waiting for an ACK/NACK? Y
es,
        JNB     TX_7,UART_RET           ; No, Are we currently transmitting? No,
 return
        CALL    END_SEND                ; Yes, end the current message that we a
re sending

  32$:  CLR     SYS_STARTUP             ; Clear the system startup flag
        CLR     WAIT_ACK_NACK           ; Clear the wait indicator
        INC     NACK_COUNT              ; Increment the number of times we got a
 NACK
        MOV     A,NACK_COUNT
        CJNE    A,#MAX_NACK +1,35$      ; Have we exceeded the max # of NACK's?
No
        CALL    BUMP_FRONT_TX           ; Yes, get rid of the last msg transmitt
ed
        MOV     NACK_COUNT,#ZERO        ; Clear out the number of NACK's we rcvd
  35$:  CLR     TX_7                    ; Clear the flag to enable transmitting
to the host
        SJMP    UART_RET                ; Return

  40$:  SETB    SEND_NACK               ; Unknown byte was sent, send a NACK to
the host
        SJMP    UART_RET

  HOST_CONTINUE:                                ; In the middle of a message
        JB      CHANNEL_RCVD,10$        ; IF the channel number was not received
        SETB    CHANNEL_RCVD            ; THEN set the flag to indicate it was
        CALL    GET_BUF                 ; Get the addr of the buffer in the DPTR
        CALL    READ_CHAR               ; Read the destination channel
        JB      READ_ERROR,25$          ; If there was an error, set the flag to
 send a NACK
```

```
        MOVX    @DPTR,A                 ; Otherwise, save the channel number in
the buffer
        CALL    INC_BUF                 ; Increment the Buffer pointer to the ne
xt location

        SJMP    CALC_C                  ; Calc. the checksum, and save the curre
nt buffer ad

 10$:   JB      SIZE_RCVD,20$           ; ELSE IF the size byte was not received
        SETB    SIZE_RCVD               ; THEN set the flag to indicate it was
        CALL    GET_BUF                 ; Get the current buffer addr. in the DP
TR

        CALL    READ_CHAR               ; Read the size byte
        JB      READ_ERROR,25$          ; If there was an error, set the flag to
 send a NACK

        MOVX    @DPTR,A                 ; Save the size byte
        CALL    INC_BUF                 ; Increment the buffer pointer
        MOV     HOST_SIZE,A             ; Save the size byte

        SJMP    CALC_C                  ; Calculate the checksum and save the cu
rrent buffer

 20$:   MOV     A,#ZERO
        CJNE    A,HOST_SIZE,30$         ; IF the size is zero
        CALL    READ_CHAR               ; THEN read the checksum byte
        JB      READ_ERROR,25$          ; If there was an error, set the flag to
 send a NACK

        SUBB    A,RX_CHECKSUM           ; Subtract the calculated checksum
        JNZ     25$                     ; Error - send a NACK
        SETB    SEND_ACK                ; No error, set the bit to send an ACK

        CALL    END_MSG                 ; End the message buffer

        LJMP    UART_RET                ; Return

 25$:   SETB    SEND_NACK               ; Set the bit to send a NACK
        CLR     RX_7                    ; Clear the receive in process flag
        CLR     CHANNEL_RCVD            ; Clear the flag to indicate the channel
 number was
        CLR     SIZE_RCVD               ; Clear the flag to indicate the size by
te was recei
        LJMP    UART_RET                ; Return

 30$:   MOV     A,HOST_SIZE             ; Get the size byte
        DEC     A                       ; And Subtract one
        MOV     HOST_SIZE,A             ; Save it

        CALL    GET_BUF                 ; Get the buffer address of where to sto
re it

        CALL    READ_CHAR               ; Read the character
        JB      READ_ERROR,25$          ; If there was an error, set the flag to
 send a NACK

        MOVX    @DPTR,A                 ; Store the byte
        CALL    INC_BUF                 ; Increment the buffer pointer
 CALC_C:
        ADD     A,RX_CHECKSUM           ; Add the byte to the running checksum
        ADDC    A,#ZERO                 ; Add in the carry flag
        MOV     RX_CHECKSUM,A           ; Save the running checksum byte
        CALL    INIT_CTR                ; Init the timer for this channel
        CALL    SAVE_BUF                ; Save the current buffer address
        LJMP    UART_RET

        PAGE
 ;;;
```

```
;       DESCRIPTION:    This section of code handles the transmition to the
;                       peripherals and the host.  This code also handles
;                       sending an ACK/NACK to the host in response to a
;                       message.
;
;       INPUT:  R7 = Channel number.
;
;       OUTPUT: Byte sent to the appropriate device.
;
;;;
```

```
        LCALL   INC_BUF             ; Point to the next location to send
        LCALL   SAVE_BUF            ; Save it away for the next time in
        LJMP    UART_RET            ; Return

 40$:   LCALL   GET_BUF             ; Get the addr of the next byte to send
        LCALL   GET_TX_SIZE         ; Get the number of bytes left to send
        SJMP    15$                 ; Check the size and send the byte


 TX_HOST:
        MOV     DPTR,#TEMP_SEND     ; Init the DPTR to the location for send
ing
                                    ; single bytes (ie. ACK, NACK, SOH)
        JB      TX_7,TX_HOST_CONT   ; We've already sent out SOH (in the mid
dle of a pac

        JNB     SEND_ACK,10$        ; Don't need to send an "ACK"
        MOV     A,#ACK              ; Set up to send an ACK
        CLR     SEND_ACK            ; Clear the flag
        CALL    TX_OFF              ; Turn off the transmitter
        SJMP    30$                 ; Send it
 10$:   JNB     SEND_NACK,20$       ; Don't need to send a "NACK", go send t
he msg.
        MOV     A,#NACK             ; Set up to send an NACK
        CLR     SEND_NACK           ; Clear the flag
        CALL    TX_OFF              ; Turn off the transmitter
        SJMP    30$                 ; Send it

 20$:                           ; Make sure something is in the queue first!!
        MOV     A,#FRONT_TX_QUE_PTR
        ADD     A,R7                ; Get the pointer for the front of the q
ueue
        MOV     R1,A                ; Use R1 as the pointer
        MOV     A,#REAR_TX_QUE_PTR  ; Get the pointer for the rear of the qu
eue
        ADD     A,R7
        MOV     R0,A                ; Use R0 as the pointer
        MOV     A,@R1
        XRL     A,@R0               ; Compare to maks sure there actually is
 something i
        JNZ     25$                 ; There is, continue
        CALL    TX_OFF              ; There isn't, turn this transmitter off
!
        LJMP    UART_RET

 25$:   SETB    TX_7                ; 1st time in (Send the msg, not ACK/NAC
K)
        MOV     A,#SOH
        MOV     TX_CHECKSUM,#SOH    ; Init the checksum to 1

 30$:   MOVX    @DPTR,A             ; Store the byte to send to the host
        LCALL   SEND_BYTE           ; Send it

        CALL    INIT_KA             ; Init the keep alive timer
        LJMP    UART_RET            ; Return
 TX_HOST_CONT:                      ; A msg packet has already been started,
 continue
        JB      CHANNEL_SENT,10$    ; Has the channel # been sent already?
        LCALL   DE_QUE_TX           ; No, get the buffer addr. to send in th
e DPTR and T
        LCALL   SEND_BYTE           ; Send the channel number
        ADD     A,TX_CHECKSUM       ; Add in the channel # to the checksum
        ADDC    A,#ZERO             ; Add in the carry
        MOV     TX_CHECKSUM,A       ; and save it
        SETB    CHANNEL_SENT        ; Set the flag for channel sent
        SJMP    END_TX_HOST_CONT    ; Return - Save the buffer first

 10$:   JB      SIZE_SENT,20$       ; Size of the msg been sent out yet?
        SETB    SIZE_SENT           ; Set the flag to indicate the size was
sent
```

```
        LCALL   GET_BUF                 ; Get the buffer addr in DPTR
        LCALL   SEND_BYTE               ; Send the size byte to the host
        MOV     TX_SIZE,A               ; Put the size byte in local storage
        ADD     A,TX_CHECKSUM           ; Add in the size to the checksum
        ADDC    A,#ZERO                 ; Add in the carry flag
        MOV     TX_CHECKSUM,A           ; and save it
        LCALL   SAVE_TX_SIZE            ; Save the size in a global location
        SJMP    END_TX_HOST_CONT        ; Clean up before exiting

  20$:  LCALL   GET_TX_SIZE             ; Size has been sent, get the size in lo
cal mem
        CJNE    A,#ZERO,30$             ; Any more msg bytes to send?
        MOV     A,TX_CHECKSUM           ; No, just the checksum
        MOVX    @DPTR,A                 ; Save the checksum
        LCALL   SEND_BYTE               ; Send the checksum to the host
        LCALL   END_SEND                ; Turn off the transmitter, etc.

        CALL    INIT_KA                 ; Init the keep alive timer
        LJMP    UART_RET                ; Return

  30$:  LCALL   GET_BUF                 ; Get the buffer addr in DPTR
        LCALL   SEND_BYTE               ; Size was not zero, sent the msg byte
        ADD     A,TX_CHECKSUM           ; Add it into the checksum
        ADDC    A,#ZERO                 ; Add in the carry flag
        MOV     TX_CHECKSUM,A           ; and save it
        DEC     TX_SIZE                 ; Decrement the size count by one
        CALL    SAVE_TX_SIZE            ; Save the size in the table

  END_TX_HOST_CONT:
        LCALL   INC_BUF                 ; Point to the next location in the msg
buffer
        LCALL   SAVE_BUF                ; Save the buffer address
        LJMP    UART_RET


        SUBTTL  DE_QUE_TX

        PAGE
  ;;;
```

```
        MOV     R0,A                    ; Place it in R0 to use as an indirect p
ointer

        MOVX    A,@R0                   ; Get the low order address of the byte
to send
        MOV     DPL,A                   ; Store it in the DPL
        INC     R0                      ; Point to the high address byte
        MOVX    A,@R0                   ; Get the high order address of the byte
 to send
        MOV     DPH,A                   ; Store it in the DPH

        CJNE    R7,#CMD_PORT,10$        ; If the channel is not the command port
, continue
        SJMP    20$                     ; Else return

  10$:  MOV     P2,#TABLE_PAGE          ; Set up to store the starting addr. in
TX_BUFFERS
        MOV     A,#LOW TX_BUFFERS       ; Beginning address of the buffer
        ADD     A,R6                    ; Add in the offset to the table
        MOV     R0,A                    ; Use R0 as the pointer
        MOV     A,DPL
        MOVX    @R0,A                   ; Save the low order address
        INC     R0                      ; Point to the next location
        MOV     A,DPH
        MOVX    @R0,A                   ; Save the high order address

  20$:  RET

        SUBTTL  SEND_BYTE

        PAGE
  ;;;
```

```
;                       the device.  It increments the FRONT_TX_QUE_PTR,
;                       clears the TX_IN_PROCESS flag (for the channel),
;                       and turns off the transmitter interrupt for that channel
;
;       INPUT:  R7 - channel number
;
;       OUTPUT: FRONT_TX_QUE_PTR(CHANNEL) := FRONT_TX_QUE_PTR(CHANNEL) + 2
;               TX_IN_PROCESS (CHANNEL) := 0
;
;;;
```

```
        SUBTTL  GET_TX_SIZE

        PAGE
  ;;;
```

```
        MOV     P2,#TABLE_PAGE          ; Upper addr. of the table page
        MOV     A,#LOW RX_TIME_OUT      ; Lower address of the timer table
        ADD     A,R7                    ; Offset to the appropriate channels tim
er byte
        MOV     R0,A                    ; Use R0 as the pointer
        MOV     A,#ZERO                 ; Clear the accumulator
        MOVX    @R0,A                   ; Clear the timer value for this channel

        CJNE    R7,#HOST_PORT,10$       ; Clear the following flags only if it's
 for channel
        CLR     CHANNEL_RCVD            ; Clear the flag to indicat the channel
number was r
        CLR     SIZE_RCVD               ; Clear the flag to indicate the size of
 the msg was

  10$:  POP     ACC
        MOV     R0,A                    ; RESTORE R0
        POP     ACC                     ; AND R1
        MOV     R1,A
        RET

        subttl  QUE_BUFFER

        PAGE
  ;;;
```

```
        ADD     A,DPL                   ; Point to the appropriate buffer pointe
r
        MOV     DPL,A                   ; Put it back into the DPTR
        MOVX    A,@DPTR                 ; Get the low order byte of the buffer
        MOVX    @R0,A                   ; Place it in the location pointed to by
 the REAR of
        INC     DPTR                    ; Point to the high order byte
        INC     R0                      ; Point to the high order byto of the Re
ceive queue
        MOVX    A,@DPTR                 ; Get the high order buffer address byte
        MOVX    @R0,A                   ; Save it in the Receive queue

        MOV     DPH,A                   ; Put the buffer address into the data p
ointer
        DEC     R0
        MOVX    A,@R0                   ; Get the low order byte
        MOV     DPL,A                   ; And store it into the low order byte o
f the data p
        CLR     C                       ; No error
        RET


  10$:  MOV     A,@R1                   ; Get the rear pointer last used
        MOV     R0,A                    ; And place it in R0

        MOVX    A,@R0                   ; Get the low order addr of the buffer l
ast used
        MOV     DPL,A                   ; And put it in the low byte of the data
 pointer
        INC     R0                      ; Point to the high order byte
        MOVX    A,@R0                   ; Get it
        MOV     DPH,A                   ; Place it in the high order byte of the
 data pointe
        SETB    C                       ; No room left in the queue
        RET

        SUBTTL  READ_CHAR

        PAGE
  ;;;
```

```
        MOV     R1,#LOW BASE_RX         ; Read the byte that was received, even
if there was
        LCALL   CHANADR1
        MOVX    A,@R1
        RET


        SUBTTL  SAVE_BUF


        PAGE
  ;;;
```

```
GET_BUF:
        PUSH    ACC
        MOV     P2,#TABLE_PAGE          ; Page for the buffer pointers

        JNB     IN_RX,10$               ; If not in the receiver, then get the t
ransmitter b
        MOV     A,#LOW RX_BUFFERS       ; Low order address for the receiver buf
fers
        SJMP    20$

 10$:   MOV     A,#LOW TX_BUFFERS       ; Low order address for the transmitter
buffers

 20$:   ADD     A,R6                    ; Point to the appropriate entry in
        MOV     R1,A                    ; the table
        MOVX    A,@R1                   ; Get the low order byte for the next
        MOV     DPL,A                   ; free location in the buffer
        INC     R1                      ; Point to the high byte
        MOVX    A,@R1                   ; Get the high order byte
        MOV     DPH,A
        POP     ACC
        RET

        SUBTTL  RX_ERROR

        PAGE
;;;
```

```
15$:    CJNE    R7,#HOST_PORT,20$       ; Error on the host port?
        SETB    READ_ERROR              ; Yes, set the flag.
        SJMP    ERROR_END               ; Return

20$:                                    ; Error on a peripheral port
        CALL    FRONT_BUFFER            ; Get the address of the 1st byte in the
buffer

        MOVX    A,@DPTR                 ; Get the header byte
        ORL     A,#HDR_ERROR_BIT        ; Set the error bit in the header
        MOVX    @DPTR,A                 ; Store the header back in the buffer

ERROR_END:
        POP     DPL
        POP     DPH
        RET

        subttl  FRONT_BUFFER
        page
;;;
```

```
;
;       INPUT: R7 - Channel number
;              RX_DEF_T_O - Table of time out values
;
;       OUTPUT: RX_TIME_OUT(R7) - Time out value for the channel in R7.
;
;;;
```

```
;
;       INPUT:  R7 - Channel number
;
;       OUTPUT: Transmitter interrupt (R7) is off.
;
;;;
```

```
HANDLE_OVRFLOW:
        MOV     A,R7                        ; Set up the header byte with the channe
l number
        ORL     A,#HDR_SYS_ERR              ; And the system error bit set
        MOVX    @DPTR,A                     ; Place the header in the buffer
        CALL    INC_BUF                     ; Bump the data pointer
        MOV     A,#1                        ; Size of the data in the buffer is one
        MOVX    @DPTR,A                     ; Store the size byte
        CALL    INC_BUF                     ; Bump the data pointer
        MOV     A,#QUE_OVERFLOW_ERR         ; Put the queue overflow error into the
buffer
        MOVX    @DPTR,A                     ; Store the error byte
        CALL    INC_BUF                     ; Bump the data pointer
        CALL    SAVE_BUF                    ; Save the next free buffer location

        CALL    READ_COMMAND                ; Read the command register and
        ANL     A,#NOT BIT2                 ; Clear the receiver enable bit
        CALL    WRITE_COMMAND               ; Turn off the receiver for this port
        MOV     P2,#HIGH PORT_TIME_OUT      ; Set up the timer so it will turn the p
ort
        MOV     A,#LOW PORT_TIME_OUT        ; back on after it's time out
        ADD     A,R7                        ; Offset to this channels timer
        MOV     R0,A                        ; Use R0 as the indirect pointer
        MOV     A,#PORT_OFF                 ; Timer value
        MOVX    @R0,A                       ; Set up the timer
        RET

;       END
```

What is claimed is:

1. A method of indicating a function status which can be one of three function states, comprising upon detecting a first state, lighting a bicolor LED with a first color; upon detecting a second state, lighting the LED with a second color; and upon detecting a third state, alternately lighting said LED with said first and said second colors at a sufficiently high rate to cause the color of said LED to appear as a third color, said function states being indicated by a 2 bit binary code and further include:

generating a first signal when both of said binary its are in a first binary state;

coupling said first signal to the preset input of a D type flip flop;

generating a second signal when a first of said binary signals is in a second state and a second of said binary signals is in said first state;

coupling said second signal to the clear input of the D type flip flop;

and generating a third signal when said second bit is in said second state;

providing a clock oscillator having a clock signal;

performing an And operation on said clock signal with said third signal;

providing said clock signal as the clock input to a flip flop;

coupling one of the outputs of said D type flip flop to its D input to alternate the outputs of the D type flip flop;

using said first signal to energize the first color of said LED;

using said second signal to energize the second color of said LED;

utilizing said third signal by triggering said D-type flip flop to generate an alternating signal to alternately energize said first and second colors in said LED.

2. A method according to claim 1 wherein:

said step of generating said first signal comprises Anding together signals representing the first state of said first and second bits; and said step of generating said second signal comprising Anding together signals representing the second state of said first bit and the first state of said second bit.

3. Apparatus for indicating a function status which can be one of three function states wherein said function states are indicated by a two bit binary code, comprising:

means for detecting first, second and third states and providing as outputs first, second and third signals corresponding to said first, second and third states;

means for generating said first signal when both of said binary bits are in a first state;

means for generating said second signal when a first of said binary bits is in a second state and a second of said binary bits is in said first state;

means for generating said third signal when said second bit is in said second state;

a bicolor LED having a first cathode for a first color and a second cathode for a second color;

means for coupling said first signal to said first cathode;

means for coupling said second signal to said second cathode;

a clock oscillator generating clock pulses;

first means for Anding together said clock pulses with said third signal;

a D-type flip flop having first and second outputs and trigger input;

means for coupling said first signal to the preset input of said D type flip flop;

means for coupling said second signal to the clear input of said D type flip flop;

means for coupling one of the outputs of said D type flip flop to its D input to alternate the outputs of said D-type flip flop;

means for coupling the outputs of said D-type flip flop respectively to the first and second cathodes of said LED; and means for coupling the output of said first means for Anding together to the trigger input of said flip flop to thereby alternately energize said first and second cathodes at a sufficiently high rate to cause the color of said LED to appear as a third color.

4. Apparatus according to claim 3 wherein said means for generating said first signal comprise:

means for Anding together signals representing the first state of said first and second bits; and said mean for generating said third signal comprise means for Anding together a signal representing the second state of said first bit and the first state of said second bit.

* * * * *